US008128755B2

(12) United States Patent
Sakata

(10) Patent No.: US 8,128,755 B2
(45) Date of Patent: Mar. 6, 2012

(54) CLEANING SOLVENT AND CLEANING METHOD FOR METALLIC COMPOUND

(75) Inventor: Yoichi Sakata, Tokyo (JP)

(73) Assignee: L'Air Liquide Societe Anonyme pour l'Etude Et L'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 12/817,777

(22) Filed: Jun. 17, 2010

(65) Prior Publication Data

US 2011/0214689 A1 Sep. 8, 2011

Related U.S. Application Data

(60) Provisional application No. 61/310,134, filed on Mar. 3, 2010.

(51) Int. Cl.
*B08B 3/04* (2006.01)

(52) U.S. Cl. ..... 134/30; 510/175; 510/505; 134/1; 134/21; 134/22.1; 134/22.11; 134/22.14; 134/22.19; 134/26; 134/34; 134/35; 134/36; 134/42; 216/24; 216/83; 438/745

(58) Field of Classification Search ..... 510/175, 510/505; 134/1, 21, 22.1, 22.11, 22.14, 22.19, 134/26, 30, 34, 35, 36, 42; 216/24, 83; 438/745
See application file for complete search history.

(56) References Cited

U.S. PATENT DOCUMENTS 4,175,012 A * 11/1979 MacKay et al. ..... 205/581
4,272,492 A * 6/1981 Jensen ..... 423/24
5,221,366 A * 6/1993 Roberts et al. ..... 148/22
5,730,804 A 3/1998 Gomi et al.
5,888,308 A 3/1999 Sachdev et al.
5,972,862 A 10/1999 Torii et al.
5,993,679 A * 11/1999 Koide et al. ..... 216/74
6,457,479 B1 * 10/2002 Zhuang et al. ..... 134/1.3
6,656,376 B1 * 12/2003 Fritsch et al. ..... 216/75
2002/0065204 A1 5/2002 Wojtczak et al.
2002/0068685 A1 6/2002 Wojtczak et al.
2003/0004073 A1 1/2003 Everson et al.
2004/0161933 A1 8/2004 Takashima et al.
2004/0175964 A1 9/2004 Chou et al.
2004/0204329 A1 10/2004 Abe et al.

(Continued)

FOREIGN PATENT DOCUMENTS

JP 9 124658 5/1997

(Continued)

OTHER PUBLICATIONS

Patent Abstract of Japan, publication No. 64-069014, publication date Mar. 15, 1989, application No. 62-227007, application date Sep. 10, 1987.

(Continued)

*Primary Examiner* — Sharidan Carrillo
(74) *Attorney, Agent, or Firm* — Patricia E. McQueeney

(57) ABSTRACT

Disclosed are cleaning solvents and cleaning methods for metallic compounds deposited on the equipment that supplies organometallic compounds to the manufacturing tool in the photovoltaic industry or the semiconductor industry. The cleaning solvents and the cleaning methods disclosed not only selectively remove the metallic compound without corroding the equipment, but also improve the ordinary cleaning process. Moreover, the cleaning solvents and the cleaning methods disclosed improve maintenance costs for the supply system because the equipment may be cleaned without being detached from the supply system.

8 Claims, 15 Drawing Sheets

U.S. PATENT DOCUMENTS

| | | | | |
|---|---|---|---|---|
| 2004/0231707 | A1* | 11/2004 | Schilling et al. | 134/34 |
| 2004/0259761 | A1 | 12/2004 | Yokoi et al. | |
| 2005/0139234 | A1* | 6/2005 | Dobashi et al. | 134/19 |
| 2008/0139436 | A1 | 6/2008 | Reid | |
| 2008/0173328 | A1 | 7/2008 | Nishiwaki | |
| 2009/0020140 | A1 | 1/2009 | Wan et al. | |
| 2009/0107520 | A1 | 4/2009 | Lee et al. | |
| 2009/0270304 | A1 | 10/2009 | Cermenati et al. | |

FOREIGN PATENT DOCUMENTS

| | | |
|---|---|---|
| JP | 10 256210 | 9/1998 |
| JP | 2000 208467 | 7/2000 |
| JP | 2000 345346 | 12/2000 |
| JP | 2003 126682 | 5/2003 |
| JP | 2003 129089 | 5/2003 |
| JP | 2004 039976 | 2/2004 |
| JP | 2004 149667 | 5/2004 |
| JP | 2006 322672 | 11/2006 |
| JP | 9 186107 | 7/2007 |
| JP | 2007 270231 | 10/2007 |
| JP | 2008 172016 | 7/2008 |

OTHER PUBLICATIONS

Droes, S.R. et al., "Dry etching of ZnO films with hexafluoroacetylacetone," Ad. Mater. 1998, 10, No. 14, pp. 1129-1133.

International Search Report and Written Opinion for corresponding PCT/IB2011/050832, May 24, 2011.

* cited by examiner a) The tank bottom after DEZn was decomposed at 100°C in the tank for 1 week b) The tank bottom after the tank (a) was soaked with the cleaning solvent c) The tank bottom after the tank was soaked with acid solution

CLEANING SOLVENT AND CLEANING METHOD FOR METALLIC COMPOUND

CROSS-REFERENCE TO RELATED APPLICATIONS

This application claims the benefit under 35 U.S.C. §119(e) to provisional application No. 61/310,134, filed Mar. 3, 2010, the entire contents of which are incorporated herein by reference.

BACKGROUND

Organometallic compounds are used as a material for various purposes, such as transparent conductive oxides for use in fabricating photovoltaic cells and flat panel displays. Many organometallic compounds, such as diethyl zinc (DEZn), easily decompose and, in doing so, generate metallic compounds. In the case of DEZn, decomposition produces solid Zn and ethane/ethylene which, due to the difference in vapor pressure between ethane/ethylene and DEZn, tends to accumulate in the vapor region and increase the pressure in the storage container. The metallic compound gradually deposits in the storage tank, the supply equipment parts, and the filling lines during supply of the organometallic compounds to the manufacturing tool. This becomes problematic because the metallic compound not only contaminates the manufacturing process, but also causes stoppage of parts used in the supply system.

FIG. 1 is a diagram of a typical system that supplies a manufacturing tool 400 with an organometallic compound 211. To supply the organometallic compound 211 to manufacturing tool 400, a carrier gas 250 is introduced into the bubbler 210 through the carrier gas inlet line 251, the carrier gas inlet valve 252, and sparger 253, then the carrier gas 250 is dispersed in the organometallic compound 211 in the bubbler 210. The carrier gas 250 introduced in bubbler 210 becomes saturated with organometallic compound 211 and the saturated mixture is supplied to manufacturing tool 400 through the supply valve 242, the filter 243, the gas flow controller 244, and the supply lines 245 and 280. The supply equipment 200 includes the bubbler 210, the supply line 245, line 233, and the parts located on line 245 and line 233, for example, the gas mass flow controller 244 and the filter 243. The supply line 280 is the pipe between the supply equipment 200 and the manufacturing tool 400, denoted by the arrows. Supply line 280 may also have parts located thereon, for example, valves, connections, gas flow controllers, gas flow meters, filters, etc, (not shown). The refill line 180 is the pipe between the supply equipment 200 and the filling valve 142 installed on the storage tank 110 located in the refilling equipment 100, which is also denoted by arrows. The refill line 180 may also contain parts, such as a liquid mass flow controller 144 etc.

Keeping the level of organometallic compound 211 constant in the supply equipment bubbler 210 is possible thanks to refilling equipment 100 even during usage of the organometallic compound 211 in the bubbler 210. The organometallic compound 211 may be used continuously without emptying the bubbler 210. The storage tank 110 mentioned above fills liquid organometallic compound III into the bubbler 210. To fill the bubbler 210 with the organometallic compound III, a carrier gas 150 is introduced into the storage tank 110 through the carrier gas inlet line 151 and the carrier gas inlet valve 152, and the storage tank 110 is pressurized. The organometallic compound III is then transported through the siphon tube 141, the filling valve 142, the filling line 143, the liquid mass flow controller 144, the supply equipment line 233, and the filling valve 232, filling the bubbler 210 with the compound 111.

As the storage tank 110 becomes empty, the tank 110 is sent to a chemical maker. The continuous supply of organometallic compound to the bubbler 210 is maintained by providing another storage tank 110. The metallic compound (not shown) deposited on the tank 110 is removed by the chemical maker regularly before the tank 110 is filled with new or fresh organometallic compound 111. The storage tank 110 filled with new organometallic compound 111 may then be connected to the supply equipment 200 and used again.

The storage tanks used in the semiconductor industry or the photovoltaic industry are typically made of steel, for example stainless steel. Because the metallic compound deposited in the storage tank is difficult to dissolve in most organic solvents, a strongly corrosive acid solution, such as a hydrofluoric acid or nitric acid solution, is typically used as the cleaning solvent prior to filling the storage tank with fresh organometallic compound. Cleaning the storage tank of the metallic compound that has deposited on it is associated with several difficulties. Many organometallic compounds, such as DEZn, react violently with water and therefore any residual DEZn that remains in the tank may react with water in the hydrofluoric or nitric acid solution. The violent reaction may create hazardous conditions that must be controlled.

A second issue related to the use of a hydrofluoric or nitric acid solution is the attack of the acid on the material of which the storage tank is comprised. Strong acids will corrode steels, and therefore the exposure time should be minimized to limit any negative impact on the steel material. Therefore, control of the cleaning process, acid concentration, and acid cleaning time is essential when cleaning the decomposed metallic compound from stainless steel storage tanks to avoid corrosion. Rinsing the storage tank with pure water for a long time to remove the remaining acid is also necessary to prevent the tank from corrosion after acid cleaning. Moreover, purging the storage tank with nitrogen for a long time is necessary to dry the tank after the pure water rinse to avoid causing a violent reaction between the organometallic compound such as DEZn and any residual water in the storage tank.

Selectively cleaning the metallic compounds deposited on a device made of steel without corrosion of the device is difficult. Therefore, accurate control of the acid concentration and the acid cleaning time are necessary to avoid corroding the device. As a result, cleaning any device (e.g. storage tank, valve, tubing, flow controller etc.) using a classical acidic solution such as hydrofluouric or nitric acid is a complex process because adequate acid exposure time must be ensured to remove the decomposed metallic compound without damaging the materials of which the device is comprised and ensuring a process so that the organometallic compound never comes in contact with water to avoid any potentially violent reaction. As a result, the cleaning process using acidic solution has many steps and as a result is long and costly.

The reason that it takes a long time to clean the storage tank and that the ordinary cleaning process requires accurate control is that the acid solution has a substantial amount of water in it (>50% $H_2O$ by weight) and water reacts violently with many organometallic compounds, such as DEZn. Nevertheless, acid solutions have typically been used as the cleaning solution for stainless steel storage tanks or other devices, even though the acid has corrosive properties against steel, as effective alternative solvents have not been identified or used in the industry. The usage of other types of cleaning solutions, for example those containing surfactants, have not been used because these solutions typically contain atoms such as sodium or potassium, which are contaminants that negatively affect the performance of semiconductor devices and solar cells. The acid solution is widely used due to the above-mentioned reasons. However, when the acid solution is used as a cleaning solvent, it is necessary to control the concentration of the acid accurately, and to manage the acid cleaning time accurately, resulting in a complicated cleaning process.

After the storage tank is cleaned by the acid solution, a pure water rinse of the tank is necessary for an extended time period (several minutes to hours) in order to remove the acid from the storage tank because the tank may corrode if any small amount of acid remains. Moreover, the tank then requires a nitrogen purge for an extended period of time (minutes to hours, but typically longer than the pure water rinse time), requiring a large amount of nitrogen to dry the tank after the pure water rinse.

Considerable caution and a skilled technique are needed to clean a tank that was used for the compounds having high reactivity with water because the acid solution contains water. Therefore, cleaning solvents and cleaning methods capable of cleaning the storage tank easily and safely are needed.

On the other hand, the supply equipment parts, such as the supply lines or the filling lines, are not cleaned regularly like the storage tank. When the metallic compound is deposited on the equipment parts that supply the manufacturing tool with the organometallic compound, there are two commonly employed solutions. The first is to clean the part after disconnecting it from the organometallic compound supply system. A nitrogen purge of the part is needed before disconnecting the part, as well as a nitrogen purge and leak check after connecting. This solution takes time, personnel cost, and cleaning cost.

The second solution is to replace the part with a new part. A nitrogen purge of the part is needed before replacing, as well as a purge and leak check after replacing. This solution also takes time, personnel cost, and the cost of new part. The supply line may need to be replaced because the length of the supply pipe may be many meters long, frequently about 30 m, and therefore provides a large surface area on which the metal may deposit. An improvement to the existing two solutions would be to clean the parts in place, without disassembling the parts. This is not done in practice today because the most widely used cleaning solution is an acidic solution which may react with any residual DEZn in the part or line.

In many cases when the metallic compound deposits on the equipment parts (such as the supply line and the filling line), the parts have to be detached from the supply system and then cleaned by acid solution or exchanged for a new part. When an acid solution is used as the cleaning solvent, accurate control of the process is necessary and considerable caution and a skilled technique are needed for organometallic compounds that are highly reactive with water, as mentioned above. In addition, when the parts are cleaned after detaching from the supply system, time and personnel cost for the nitrogen purge and leak check are needed, as well as the cost of the cleaning. Detaching and cleaning of long length pipes is difficult and frequently requires replacement by a new pipe.

Cleaning solvents and cleaning methods that easily and safely clean metallic compounds deposited on the equipment parts (e.g., the supply line, the filter, the filling line) used in the semiconductor industry or the photovoltaic industry without detaching the part from the supply system are needed.

SUMMARY

Disclosed are cleaning solvents for removing a metallic compound from equipment parts used in the photovoltaic or semiconductor industry. The cleaning solvent is composed of a diluent, an accelerator, and a diketone compound having the formula R1-CO—CHR2-CO—R3, wherein R1, R2, and R3 are independently selected from the group consisting of hydrogen, an alkyl group, and an oxygen-substituted alkyl group. The diketone compound is capable of forming a β-diketonate complex with the metallic compound and the diluent is capable of dissolving the β-diketonate complex. The cleaning solvent contains no water or supercritical $CO_2$. The disclosed cleaning solvents may include one or more of the following aspects:

- the equipment parts include storage tanks, supply equipment parts, supply lines, or filling lines;
- the concentration of the diketone compound ranges from approximately 3 vol % to approximately 5 vol %;
- the diketone is acetylacetone;
- the diluent is acetonitrile;
- the metallic compound is selected from the group consisting of Zn, Ca, Co, Sr, Fe, Ba, Cu, Mg, V, Cd, Mo, Pb, Ni, Al, Pt, Pd, Mn, Yb, Y, In, Gd, Er, Ga, Sm, Dy, Ce, Tm, Nd, Hf, Ho, La, Lu, Ru, Rh, Ti, Zr, Cr, Ge, Nb, Sn, Sb, Te, Cs, Ta, W, metal oxides thereof, and mixtures thereof;
- the metallic compound is selected from the group consisting of Al, Ga, In, Sn, Zn, Cd, metal oxides thereof, and mixtures thereof;
- the metallic compound is Zn and ZnO;
- the concentration of the accelerator ranges from approximately 3 vol % to approximately 5 vol %;
- the accelerator is a tertiary amine; and
- the accelerator is triethylamine, Also disclosed is a method of cleaning equipment parts used in the photovoltaic or semiconductor industry with the disclosed cleaning solvents. The surface of the equipment parts contaminated with a metallic compound is contacted with the disclosed cleaning solvent. The cleaning solvent is then removed, removing with it the metallic compound from the surface of the equipment parts. The disclosed cleaning methods may include one or more of the following aspects:

- heating the cleaning solvent during the contacting step;
- sonicating the cleaning solvent during the contacting step;
- heating and sonicating the cleaning solvent during the contacting step;
- rinsing the equipment parts with the diluent after removing the cleaning solvent; and
- drying the surface of the equipment parts with an inert gas after removing the cleaning solvent.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DETAILED DESCRIPTION OF PREFERRED EMBODIMENTS

Figure 1:
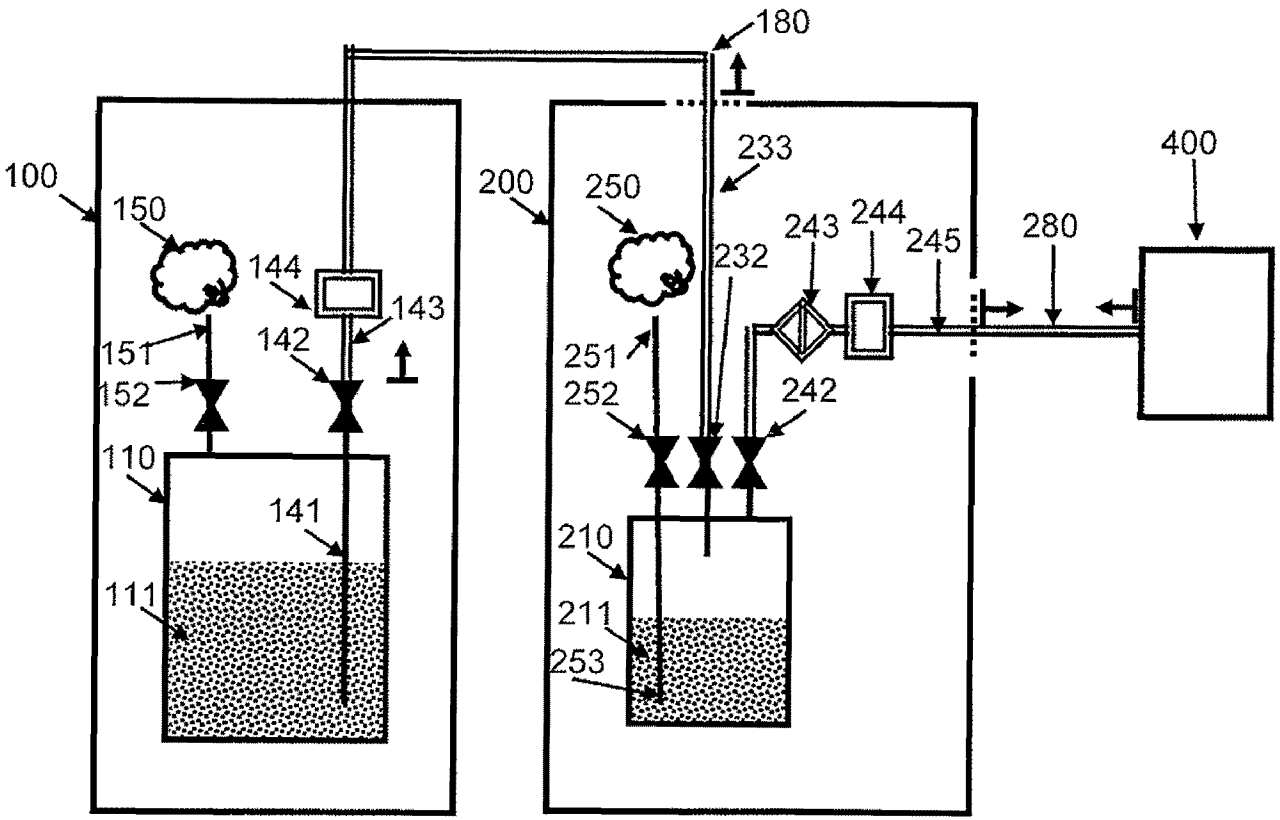
Figure 1 (Prior Art)
FIG. 1 is a diagram of a prior art system to supply a manufacturing tool with organometallic compound.

Disclosed herein are non-limiting embodiments of compositions and methods used in the manufacture of semiconductor, photovoltaic, LCD-TFT, or flat panel type devices.

Disclosed are cleaning solvents and cleaning methods for metallic compounds deposited on the equipment parts (such as the storage tank, the filter, supply lines, and filling lines) that supply organometallic compounds in the photovoltaic industry or the semiconductor industry. The cleaning solvents and cleaning methods disclosed may selectively remove the metallic compound without corroding the parts, as well as improve the ordinary cleaning process.

The disclosed cleaning solvents and cleaning methods for the storage tank simplifies the ordinary cleaning process, improves cleaning time, and cleans the storage tank safely. Also disclosed are cleaning solvents and cleaning methods that clean organometallic compounds from the equipment parts without requiring the parts to be detached from the delivery system.

Moreover, the cleaning solvents and cleaning methods disclosed improve maintenance costs for the supply system that supply the manufacturing tool with organometallic compounds because the equipment parts may be cleaned without being detached from the organometallic compounds supply system.

Cleaning Solvents

The disclosed cleaning solvents contain a diketone compound that is capable of forming and forms a β-diketonate metal complex with the metallic compound due to the reaction between the diketone and the metallic compound. The disclosed cleaning solvents do not contain water or supercritical $CO_2$. Any diketone compound having [R1-CO—CHR2-CO—R3] in the structure is acceptable, wherein R1, R2, and R3 are independently selected from hydrogen, an alkyl group, and an oxygen-substituted alkyl group. For example, acetylacetone [$CH_3$—CO—$CH_2$—CO—$CH_3$] may be used.

As discussed above, the disclosed cleaning solvents contain a diketone compound having the structure having [R1-CO—CHR2-CO—R3]. In a preferred embodiment, the cleaning solvent contains the diketone compound, an accelerator, and a diluent. Any diluent is acceptable as long as it dissolves the β-diketonate complex formed by the reaction of the diketone compound and the metal compound. For example, the diluent may be an organic solvent, such as acetonitrile, acetone, tetrahydrofuran, aromatic compounds such as benzene, toluene, ethylbenzene, and xylene, and hydrocarbons such as heptane, hexane, and oxane.

The reaction speed between the diketone compound and the metallic compound increases with the addition of an accelerator. The accelerator may be any compound that attracts a proton from the diketone compound. The accelerator should not be a gas at room temperature and pressure. Suitable accelerators include amine compounds, such as pyridine, triethylamine, diethylamine, dimethylamine, and ethylamine. Preferably, the accelerator is a tertiary amine, and more preferably triethylamine or pyridine.

The amount of the diketone compound and the accelerator added to the diluent is sufficient if both amounts are greater than the chemical equivalent of the metallic compound. For example, when one mole of Zn is cleaned as a metallic compound, a minimum two moles each of acetylacetone and triethylamine should be contained in the cleaning solvent. in practice, the amount of solvent needed to clean a given part, storage tank, line or assembly of parts will be determined empirically taking into account the conditions, time between cleans, and the sensitivity of the manufacturing process to the presence of the metallic compound. Any metallic compound capable of forming the metal complex by reaction with the diketone compound may be utilized. The diluent must be capable of dissolving the resulting metallic complex. For example, the metallic compound may include Zn, Ca, Co, Sr, Fe, Ba, Cu, Mg, V, Cd, Mo, Pb, Ni, Al, Pt, Pd, Mn, Yb, Y, In, Gd, Er, Ga, Sm, Dy, Ce, Tm, Nd, Hf, Ho, La, Lu, Ru, Rh, Ti, Zr, Cr, Ge, Nb, Sn, Sb, Te, Cs, Ta, W, oxides of any of these metals, and mixtures thereof. Preferably the metallic compound is Al, Ga, In, Sn, Zn, Cd, oxides of these metals, and mixtures thereof.

In a particularly preferred embodiment, the cleaning solvent containing acetylacetone, triethylamine as the accelerator, and acetonitrile as the diluent may be used to clean the metallic compound (the metal and/or metal oxide). In the examples that follow, the cleaning solvent contains 4 vol % acetylacetone, 4 vol % triethylamine, and 92 vol % acetonitrile. In general, the concentrations of the diketone compound and the accelerator range from approximately 3 vol % to approximately 5 vol %, with the diluent constituting the balance.

Cleaning Methods

The disclosed cleaning methods utilize the disclosed cleaning solvents discussed above. For example, when a cleaning solvent containing acetylacetone, triethylamine, and acetonitrile is used to remove a metallic compound deposited on the equipment parts (e.g., storage tank, bubbler tank, filter, the supply line, and the filling line), the metallic compound reacts with acetylacetone and forms metal acetylacetonate in the acetonitrile. In this reaction, the triethylamine acts as an accelerator by attracting a proton of the acetylacetone. The metal acetylacetonate easily dissolves in the acetonitrile. As a result, the metallic compound dissolves into the cleaning solvent and is discharged when the solvent is flushed from the system.

At a minimum, the disclosed method includes contacting a surface of the device contaminated with the metallic compound with the disclosed cleaning solvents. During contact, heating and/or sonication may be used. The cleaning solvent is removed from the device, thereby removing the metallic compound from the surface of the equipment part. The surface of the device may then be dried with an inert gas.

Prior to contact with the disclosed cleaning solvent, the organometallic compound may be removed from the equipment parts used to supply such compounds in the photovoltaic industry or the semiconductor industry. Any known removal techniques may be used. In one embodiment, vacuum and nitrogen purge occur simultaneously. One of ordinary skill in the art will recognize that any inert gas, including nitrogen ($N_2$), argon (Ar), helium (He), or mixtures thereof, may be used in the purge. Additionally, one of ordinary skill in the art will recognize that vacuuming and purging do not need to be performed simultaneously. Furthermore, one of ordinary skill in the art will recognize that vacuuming and purging, whether or not performed simultaneously, may be repeated one or more times. For example, a nitrogen purge may be followed by a vacuum, both of which may be repeated. Alternatively, a vacuum may be followed by a nitrogen purge, which may once again be followed by the vacuum alone. The purpose of this removal step is to reduce the amount of organometallic compound remaining in the equipment part. However, as, the organometallic compound does not react in a negative manner with the disclosed cleaning solvents, as they do with water, this step is not mandatory.

The disclosed cleaning solvents are then introduced into the equipment part in order to contact the surface of the equipment part contaminated with the metallic compound. Any known method of introducing the cleaning solvents may be used. In one embodiment, the cleaning solvents are introduced into the equipment part as a rinse. The rinse may be repeated multiple times. Subsequently, the equipment part may soak in a sufficient quantity of the cleaning solvent for a period of time. One of ordinary skill in the art will recognize that rinsing and/or soaking may not be necessary in all situations. Similarly, the number and order of rinsings and soakings may be varied. For example, two rinsings may be followed by two soakings or a rinsing may be followed by a soaking which may once again be followed by a soaking.

One of ordinary skill in the art will further recognize that the amount of cleaning solvent necessary to be "sufficient" and the period of time for soaking will depend upon the type and condition of the equipment part and the amount of metallic compound deposited. In cases in which soaking occurs, the equipment part should be filled with the cleaning solvent so that all interior surfaces of the equipment part are in contact with the cleaning solvent. The amount of solvent that is needed to clean the equipment part will depend upon the cleaning frequency used, as the decomposition of the organometallic compound such as DEZn proceeds with time and the metallic compound is formed progressively.

Optionally, during contact with the cleaning solvents, the equipment part may be heated, may be subject to sonication, or both. When heating is used, the temperature should remain below the decomposition point of the metal complex. Any known heating or sonication methods may be used. For example, a wave generator may be used to sonicate multiple pieces of the equipment part. For heating, a hot bath may be used to heat individual pieces of the equipment part. Alternatively, the equipment part may be contained within a space that may be heated due to the enclosure by, for example, a hot plate. In a further alternative, heating tape may be wrapped around individual pieces of the equipment part. In another alternative, the cleaning solvent itself may be heated before delivery. One of ordinary skill in the art will recognize that any number of these alternatives may be used together in one system.

The cleaning solvents are then removed from the equipment part. Any known method of removal may be used. In one embodiment, the cleaning solvent is drained through drain valves and drain lines to a drain tank. After draining, an inert gas, such as nitrogen, argon, helium, or mixtures thereof, may be introduced into the treated equipment part and vented to an abatement system.

Any residual cleaning solvent remaining in the equipment part may be removed by rinsing with the cleaning solvent's diluent. As in the cleaning solvent contact step, any known method of rinsing may be used. In one embodiment, the diluent rinse step may include one or more rinses followed by a soak. One of ordinary skill in the art will recognize that the rinse and soak cycles may be altered and repeated, as cleansing requirements dictate. The amount of diluent used in, and the time length of, the soak will depend upon a variety of factors. The diluent soak time, however, does not need to be as long as the cleaning solvent soak time. The diluent is drained from the system and an inert gas, such as nitrogen, argon, helium, or mixtures of these, may be introduced into the treated equipment part and subsequently vented to an abatement system.

The equipment part may then be dried. An inert gas, such as nitrogen, argon, helium, or mixtures of these, is introduced into the system and sent to the abatement system until the equipment part is dry. This may be determined by measuring the water content of the inert gas. Preferably, the inert gas will have a water content of less than approximately 3 ppm, and more preferably less than approximately 50 ppb. Drying time may be accelerated by simultaneously heating the equipment part. However, compared to the prior art cleaning methods, the drying time is very fast because the disclosed cleaning solvent does not contain water and, as a result, water has not been used in the cleaning process.

EXAMPLES

In the following non-limiting examples, the disclosed cleaning solutions and cleaning methods are explained according to specific embodiments. These embodiments are provided to further illustrate the invention. However, they are not intended to be all inclusive and are not intended to limit the scope of the inventions described herein.

Example 1 Prior Art

Cleaning of Storage Tank

Figure 4:
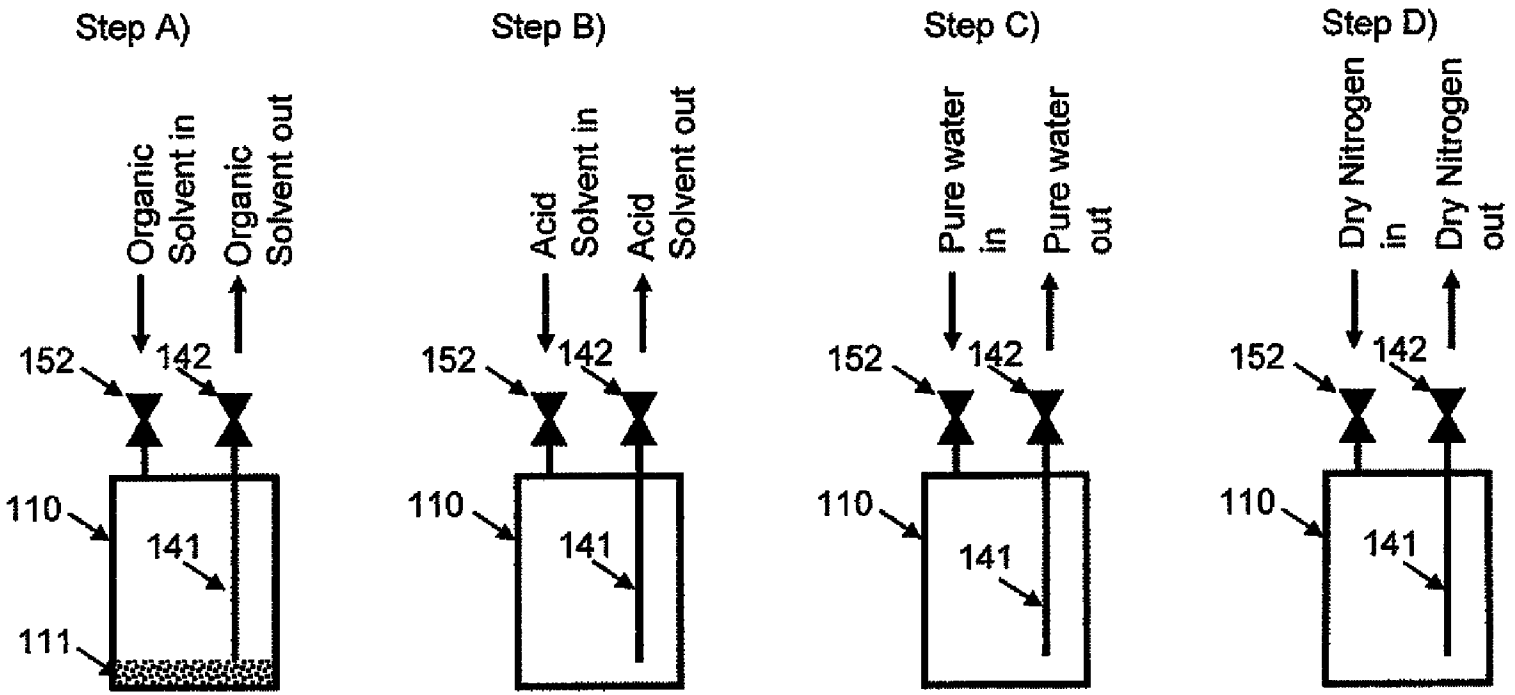
Figure 4 (Prior Art)
FIG. 4 is an illustration of the prior art cleaning method of a storage tank.

FIG. 4 is an illustration of the prior art steps required in a typical cleaning method of the storage tank 110. A small amount of an organometallic compound III, such as DEZn, remains in the storage tank 110 returned from a customer.

Step A. An organic solvent, for example, hexane or octane, is introduced through the inlet valve 152 into the storage tank 110, and the liquid in the tank 110 is stirred to mix the DEZn 111 with the organic solvent. The mixture is then discharged through the siphon tube 141 and the outlet valve 142. By repeating this step, organic solvent introduction and discharge, DEZn 111 in the storage tank 110 is removed.

Step B. Decomposed compound (Zn and ZnO) that cannot be removed by the organic solvent are cleaned with an acid solution. The acid solution is introduced through the inlet valve 152 into the storage tank 110, and then the acid solution is stirred to dissolve the decomposed compound. Afterwards, the acid solution is discharged through the siphon tube 141 and outlet valve 142. If necessary, this step may be repeated cautiously.

Step C. The acid remaining in the storage tank 110 is completely removed with pure water. Pure water is introduced into the storage tank 110 through the inlet valve 152 and then the pure water is stirred to dissolve the acid. Next, the water is discharged through the siphon tube 141 and outlet valve 142. By repeating this step, pure water introduction and discharge, the acid in the storage tank 110 is removed.

Step D. The storage tank 110 is dried by inert gas. An inert gas, such as nitrogen, argon, helium, or mixtures of these, is introduced through the inlet valve 152, and exhausted through the siphon tube 141 and the outlet valve 142 to dry the storage tank 110. This inert gas purge continues until the storage tank 110 is dry.

Figure 2:
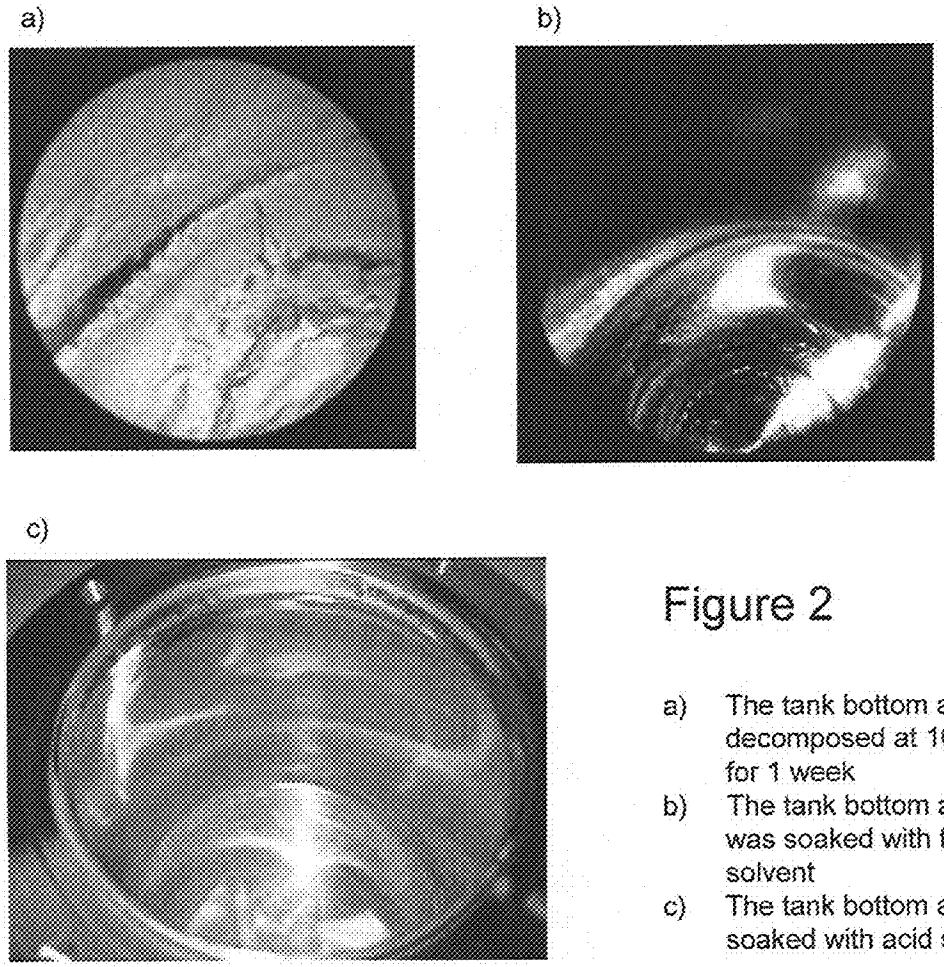
FIG. 2*a* is a picture of DEZn decomposition product deposited on a tank bottom after DEZn was stored in it at 100° C. for one week.
FIG. 2*b* is a picture of the tank bottom after soaking in the disclosed cleaning solvent.
FIG. 2*c* is a picture of the tank bottom after soaking in the prior art acid solution.

FIG. 2*c* is a picture of the inside of a tank made of stainless steel after cleaning with 5% hydrofluoric acid at room temperature for six hours. The tank no longer had a stainless steel polish on the surface due to corrosion.

Example 2

Cleaning of Storage Tank

Figure 5:
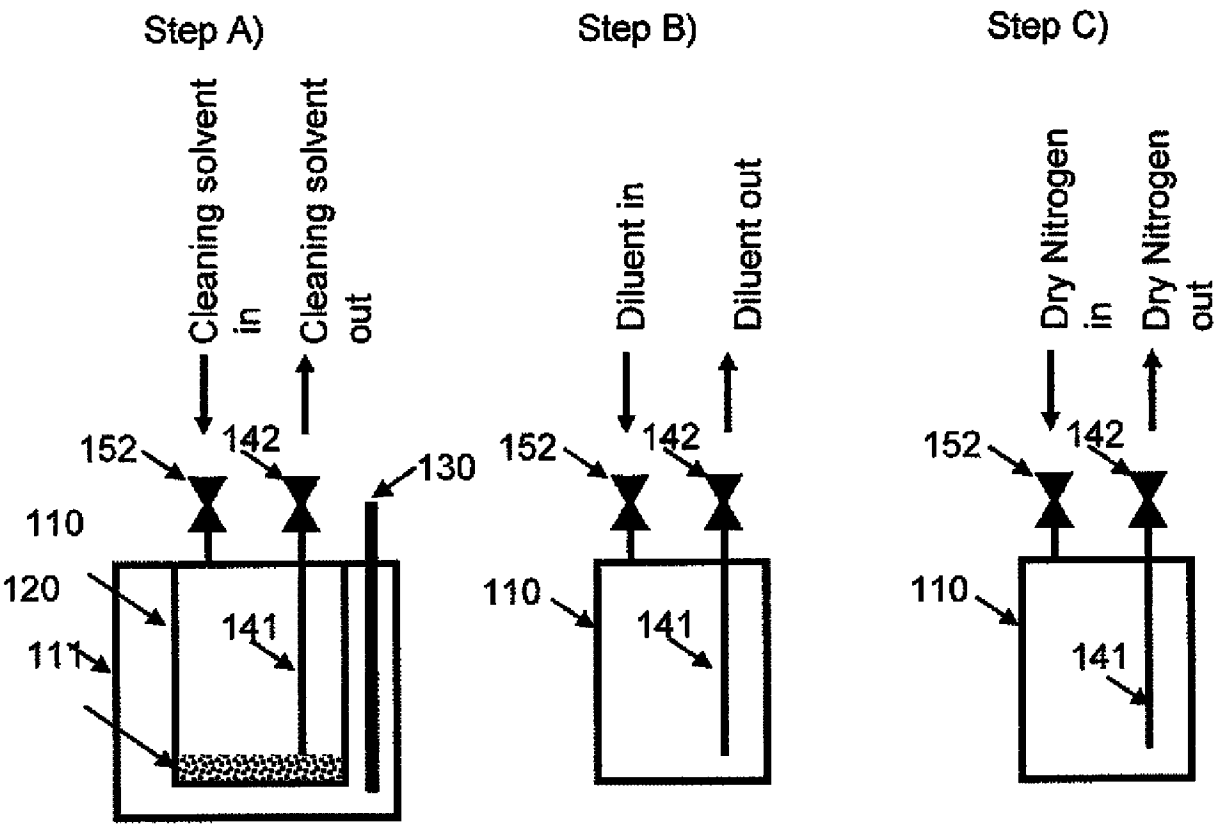
FIG. 5 is an illustration of one embodiment of the disclosed method for cleaning a storage tank.

One embodiment of the disclosed method of cleaning the storage tank 110 is explained in conjunction with FIG. 5.

The storage tank 110 used was prepared by heating the organometallic compound DEZn 111 in the tank 110 at 100° C. for one week to deposit the decomposed compound (Zn and ZnO particles) in the tank 110. A cleaning solvent was prepared having acetylacetone (4 vol %), triethylamine (4 vol %), and acetonitrile (92 vol %).

Step A. The cleaning solvent was introduced into the storage tank 110 through the inlet valve 152. The cleaning solvent in the storage tank 110 was stirred to mix with DEZn 111, and then the mixture was discharged through the siphon tube 141 and the outlet valve 142. By repeating this two times, the cleaning solvent introduction and discharge, DEZn 111 in the storage tank 110 is removed. The storage tank 110 was then completely filled with the cleaning solvent and soaked to dissolve the decomposed compounds (Zn and ZnO). During soaking, cleaning time may be reduced by heating the storage tank 110 by a hot bath 120, agitating the storage tank 110 with a supersonic wave generated by the supersonic wave generator 130, or both. When heating is used, the temperature should remain below approximately 138° C., the melting point of zinc acetylacetonate hydrate.

Step B. The cleaning solvent that remains in the storage tank 110 was completely removed with the pure acetonitrile. Acetonitrile was introduced into the storage tank 110 through the inlet valve 152. Acetonitrile in the storage tank 110 was stirred to mix with the remaining cleaning solvent and then the mixture was discharged through the siphon tube 141 and the outlet valve 142. By repeating this step two times, acetonitrile introduction and discharge, the remaining cleaning solvent in the storage tank 110 was removed.

Step C. The storage tank 110 was dried by inert gas. Nitrogen was introduced through the inlet valve 152 and exhausted through the outlet valve 142 through siphon tube 141. Purge time may be reduced by using heat, a vacuum, or both, When heating is used, the temperature should remain below the heat-resistant limit of the storage tank 110 or its components. For example, many gaskets fail at temperatures above approximately 130° C.

The before and after cleaning results are shown in FIGS. 2*a* and 2*b*. Many particles (Zn and ZnO) were deposited in the storage tank before cleaning (FIG. 2*a*). After performing the cleaning method described above, the stainless steel polish on the surface of the storage tank returned (FIG. 2*b*). The amount of Zn from the decomposed compounds (Zn and ZnO) remaining in the tank after cleaning was 0.0666 mg. The initial amount of decomposed compound before cleaning was estimated to be 50 mg. This value was estimated by weighing the decomposed compound generated from DEZn in another tank that was heated at 100° C. for one week (i.e., same condition as the tank cleaned). Therefore, the removal rate of the decomposed compound by the disclosed cleaning solvent and cleaning method was greater than 99.5% [(50.0–0.06666)/50.0*100].

Example 3

Effect of Cleaning Solvent on Stainless Steel

Figure 3:
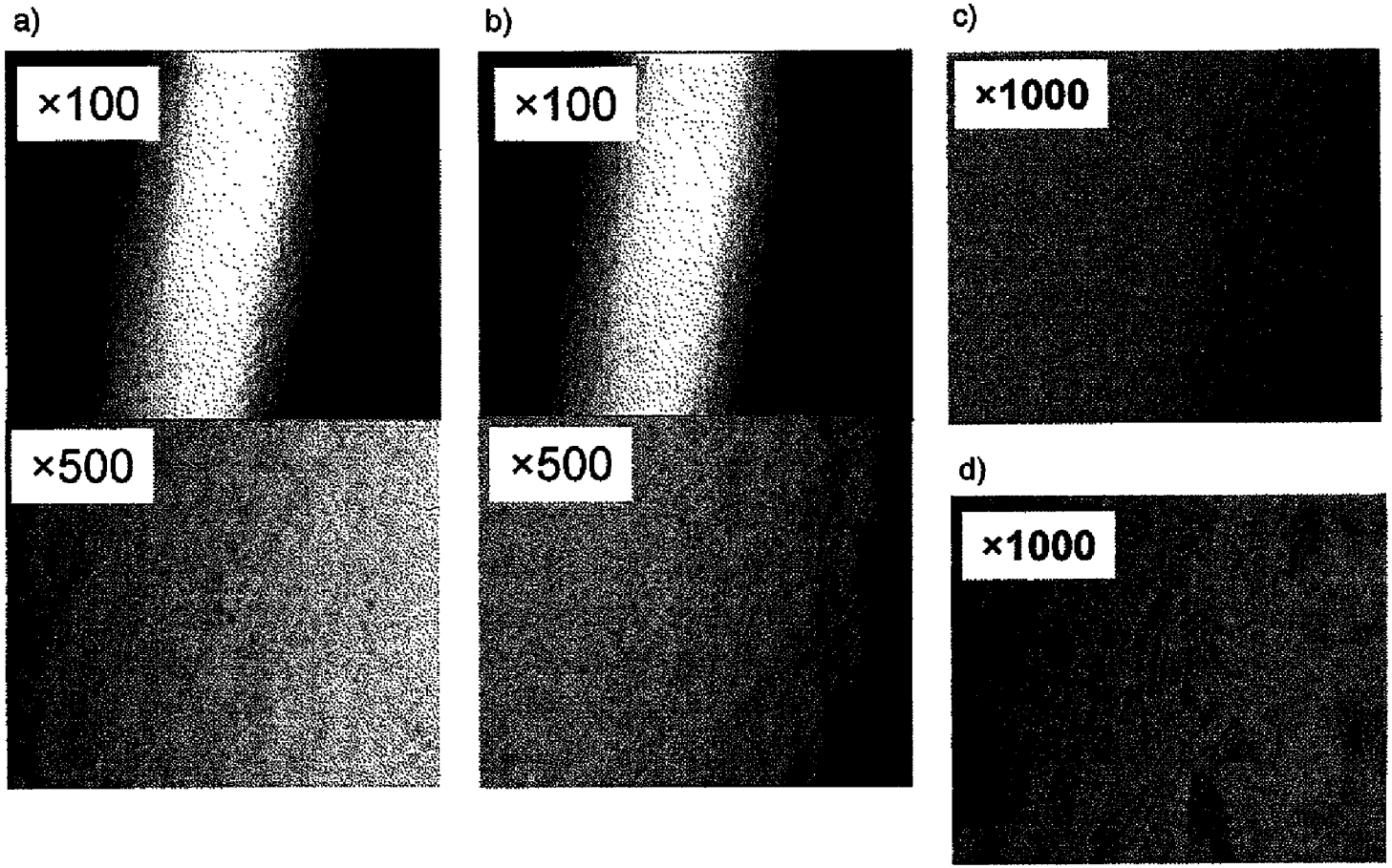
FIG. 3*a* is a picture at 100× and 500× of a stainless steel surface.
FIG. 3*b* is a picture at 100× and 500× of the same stainless steel surface after one week contact with the disclosed cleaning solvent at room temperature.
FIG. 3*c* is a picture at 1000× of a stainless steel surface.
FIG. 3*d* is a picture at 1000× of the same stainless steel surface after one hour contact with a 20% hydrofluoric acid solution.

To confirm the influence that the disclosed cleaning solvent exerts on the stainless steel, the following experiment was performed:

10 mL of the cleaning solvent was prepared having 4 vol % acetylacetone, 4 vol % triethylamine, and 92 vol % acetonitrile. The cleaning solvent was introduced and stored in a 10 mL stainless tank for one week at room temperature. There was no sign of corrosion on the surface of the tank after contact with the cleaning solvent. FIG. 3*a* is a picture amplified 100 times and 500 times of the surface of the tank before soaking, and FIG. 3*b* is a picture similarly amplified after soaking. FIGS. 3*a* and 3*b* reveal that the cleaning solvent does not corrode the stainless steel, even when the stainless steel is soaked with this solvent for an extended time that significantly exceeds typical cleaning times.

On the other hand, when stainless steel was soaked with 20% hydrofluoric acid for one hour at room temperature, the surface of stainless steel was corroded. FIG. 3*c* is a picture amplified 1,000 times of a stainless steel surface before being soaked with hydrofluoric acid. FIG. 3*d* is a picture similarly amplified after the soak. FIGS. 3*c* and 3*d* reveal that the standard cleaning solution may damage the stainless steel tank.

As a result, the disclosed cleaning solvent and cleaning method make it possible to selectively remove a target metallic compound, such as a metal and/or metal oxide, deposited on a device without corrosion of the device.

Example 4

Cleaning the Supply Lines

Figure 6:
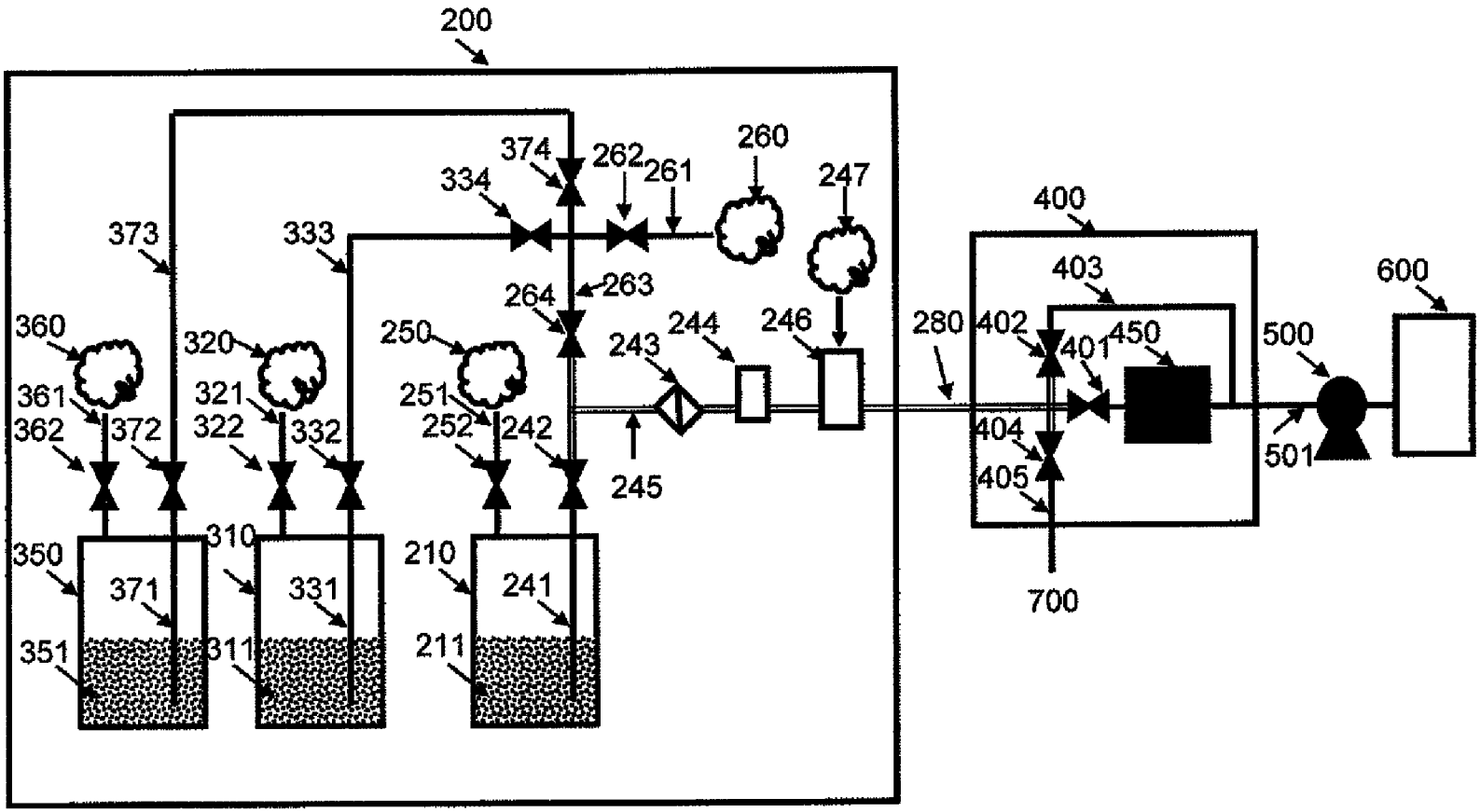
FIG. 6 is a diagram of one embodiment of a system to supply a manufacturing tool with organometallic compound.

One exemplary cleaning method of the supply lines using the disclosed cleaning solvents 311 is explained in detail in conjunction with FIG. 6. FIG. 6 is a diagram of one embodiment of a system to supply a manufacturing tool 400 with organometallic compound 211, such as DEZn, by using supply equipment 200 equipped with the disclosed cleaning solvent 311 for cleaning parts of the supply equipment 200 and manufacturing tool 400, as discussed in further detail below.

The supply equipment 200 supplies the vapor from liquid DEZn 211 to the manufacturing tool 400. When DEZn 211 is supplied to the manufacturing tool 400, an inert carrier gas 250, such as argon, is introduced into the tank 210 via the inlet line 251 and the inlet valve 252. DEZn 211 is pushed up from the siphon tube 241 and it is pushed out to the line 245 through the supply valve 242. DEZn 211 passes through the filter 243, the liquid mass flow controller 244, and the vaporizer 246 installed in the line 245. The filter 243 removes particles resulting from decomposition of DEZn 211 during storage or supply. The mass flow controller 244 accurately controls the flow rate of DEZn 211 for the purpose of stably supplying the manufacturing tool 400 with a constant amount of DEZn 211. The vaporizer 246 vaporizes the liquid DEZn 211 to gaseous DEZn (not shown). Gaseous DEZn formed in the vaporizer 246 may be diluted by the carrier gas 247, such as argon, having a controlled flow rate, by for example a mass flow controller (not shown). One of ordinary skill in the art will recognize that a carrier gas 247 different from carrier gas 250 may be used. However, typically carrier gas 247 and carrier gas 250 are the same.

The gaseous DEZn passes from line 245 to line 280, which one of ordinary skill in the art will recognize may be one line or two separate lines connected according to known techniques. Line 280 supplies the vaporized DEZn to the chamber 450 in the manufacturing tool 400 via the process valve 401.

As stated previously, DEZn is an organometallic compound that decomposes easily. The decomposed compounds (Zn and ZnO) may form deposits on the supply line during supply of DEZn. The decomposed compounds may have negative effects on the semiconductor device or solar cell module manufacturing process. As discussed above, this problem was frequently solved by detaching the supply line and exchanging it for the new supply line, which results in added cost and time loss. The disclosed cleaning methods make it possible to clean the decomposed compound from the supply line without detaching the supply line from the supply system. One embodiment of the disclosed cleaning method is explained in detail in conjunction with FIG. 6. This embodiment consists of five steps:

1. Removal of DEZn;
2. Solvent cleaning;
3. Removal of solvent;
4. Acetonitrile cleaning; and
5. Dry.

$1^{st}$ Step

Valves 242 and 401 are closed and DEZn remaining in lines 245 and 280 is removed by vacuum 500. DEZn remaining in lines 245 and 280 is exhausted with the vacuum pump 500 while nitrogen 260 is introduced from the nitrogen in-line 261, the nitrogen in-valve 262, the cleaning solvent supply line 263, and the supply valve 264. The exhaust gas containing DEZn is treated by the abatement system 600 via by-pass valve 402, by-pass line 403, and exhaust line 501. Finally, lines 245 and 280 are kept decompressed by stopping nitrogen supply.

$2^{nd}$ Step

The cleaning solvent 311 (for example, 4 vol % acetylacetone, 4 vol % triethylamine, and 92 vol % acetonitrile) is introduced into lines 245 and 280 and the decomposed compound (Zn and ZnO) is dissolved. The cleaning solvent 311 in tank 310 is pushed up from the siphon tube 331, and then introduced to lines 245 and 280 through the supply valve 332, the solvent supply line 333, the supply valve 334, the solvent supply line 263, and the solvent supply valve 264 by introducing nitrogen 320 into the tank 310 through the nitrogen inlet line 321 and the nitrogen inlet valve 322. The lines 245 and 280 filled with the cleaning solvent 311 are soaked for a constant time according to the amount of deposits. During the soak, the cleaning time may be reduced by heating, for example, by heating tape (not shown). When heating is used, the temperature should be kept below the heat-resistant limit of any parts on the lines 245 and 280.

$3^{rd}$ Step

The cleaning solvent containing zinc acetylacetonate generated by the reaction of acetylacetone and the decomposed compound (Zn and/or ZnO) is drained from the lines 245 and 280. Nitrogen 260 is introduced into lines 245 and 280 from the nitrogen inlet line 261 through the nitrogen inlet valve 262, the solvent supply line 263, and the solvent supply valve 264. The cleaning solvent is discharged to the drain tank 700 through the drain valve 404 and the exhaust line 405. After the cleaning solvent is drained to the drain tank 700, valves 264 and 401 are closed and lines 245 and 280 are vacuumed by the vacuum pump 500. The exhaust is sent to the abatement system 600 through the by-pass valve 402, the by-pass line 403, and the exhaust line 501. The lines 245 and 280 are kept decompressed at the end of this process.

Steps 2 and 3 may be repeated as necessary to increase the removal efficiency of the cleaning process.

$4^{th}$ Step

To remove residual cleaning solvent from lines 245 and 280, the lines 245 and 280 are rinsed by pure acetonitrile 351. Nitrogen 360 is introduced into the acetonitrile tank 350 through the nitrogen inlet line 361 and the nitrogen inlet valve 362. Acetonitrile 351 in the tank 350 is pushed up with the siphon tube 371 and introduced into lines 245 and 280 through the supply valve 372, the acetonitrile supply line 373, the supply valve 374, the cleaning solvent supply line 263, and the solvent supply valve 264. Acetonitrile 351 is discharged by nitrogen 260 after the lines 245 and 280 filled with acetonitrile 351 are soaked for a constant time. Nitrogen 260 is introduced into the lines 245 and 280 through the nitrogen inlet line 261, the nitrogen inlet valve 262, the cleaning solvent supply line 263, and the solvent supply valve 264, and acetonitrile 351 is drained from the drain valve 404 and the drain line 405. By repeating this step a few times, acetonitrile introduction and drain, the residual cleaning solvent in the lines 245 and 280 is well removed.

Steps 2 through 4 maybe repeated as necessary to improve the efficiency.

$5^{th}$ Step

The lines 245 and 280 are dried by nitrogen 260. Nitrogen 260 is introduced into the lines 245 and 280 through the nitrogen inlet line 261, the nitrogen inlet valve 262, the cleaning solvent supply line 263, and the supply valve 264. Nitrogen 260 is sent to the abatement system 600 through the by-pass valve 402, the bypass line 403, and the exhaust line 501. The nitrogen purge is continued until lines 245 and 280 are dried. During the nitrogen purge, purge time may be reduced by heating the lines 245 and 280, for example, by heating tape (not shown). Compared to the prior art, the drying time is very fast because water has not been used in the cleaning process. Previously, when decomposed compound deposited on the long length of supply line, replacement of the line was required. As shown in this embodiment, the lines may easily be cleaned thanks to the disclosed cleaning solvents and cleaning methods. Additionally, the lines used for DEZn may be cleaned safely as no water is used in the cleaning process and therefore violent reactions between DEZn and $H_2O$ is avoided.

Example 5

Cleaning the Filter

Figure 7:
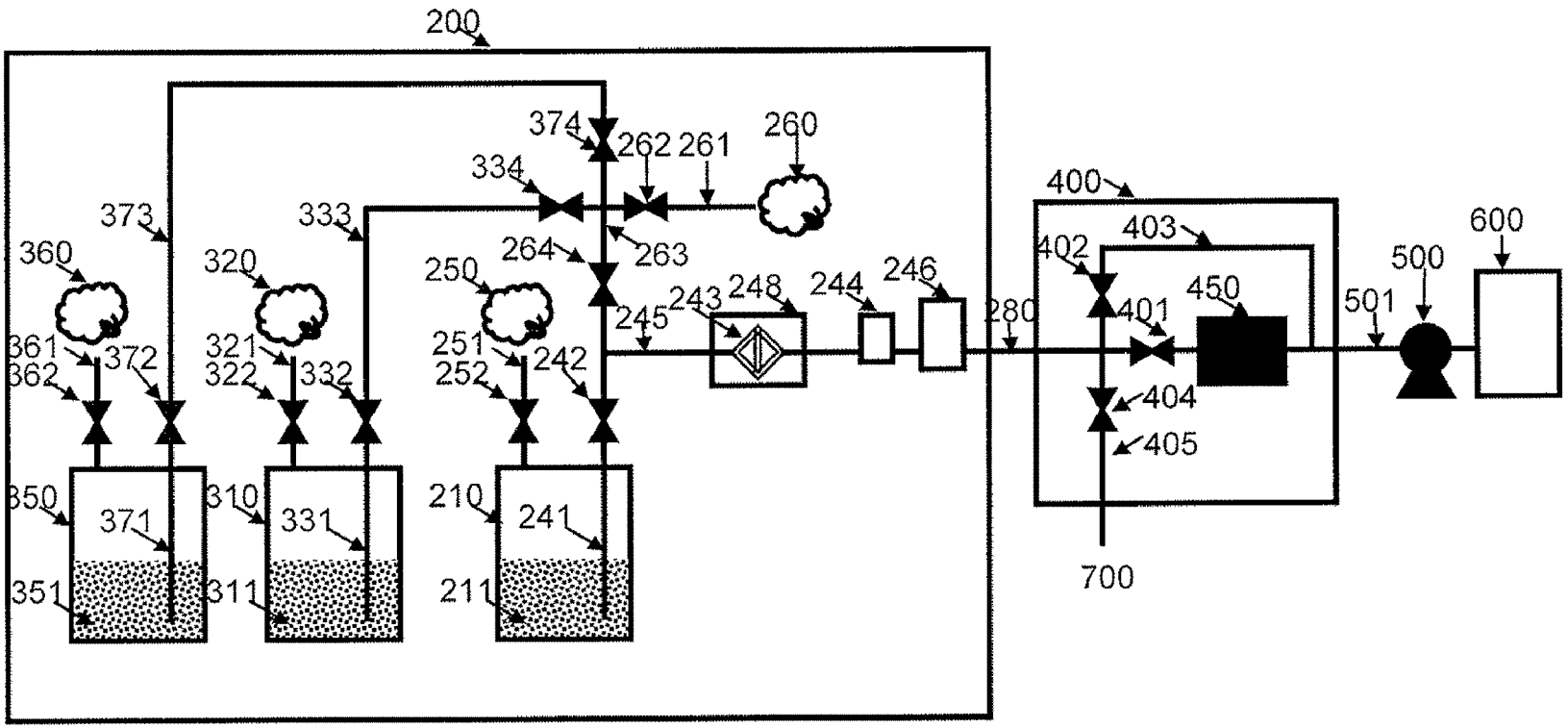
FIG. 7 is a diagram of a second embodiment of a system to supply a manufacturing tool with organometallic compound.

One exemplary cleaning method of the filter 243 using the disclosed cleaning solvent 311 is explained in detail in conjunction with FIG. 7. One of ordinary skill in the art will recognize that the filter 243 may be made of ceramic, steel, or sintered metal. FIG. 7 is a diagram of one embodiment of a system to supply a manufacturing tool 400 with organometallic compound 211, such as DEZn, by using supply equipment 200 equipped with the disclosed cleaning solvent 311 for cleaning parts of the supply equipment 200 and manufacturing tool 400, as discussed in further detail below.

To supply the chamber 450 of the manufacturing tool 400 with DEZn 211, argon 250 is introduced into the DEZn tank 210 through the argon inlet line 251 and the argon inlet valve 252. DEZn 211 is pushed up from the DEZn siphon tube 241, then DEZn 211 is sent to the chamber 450 through the supply valve 242, the DEZn supply line 245, the filter 243, the liquid mass flow controller 244, and the vaporizer 246. The filter 243 captures the particles in DEZn. The liquid mass flow controller 244 accurately controls the liquid flow rate of DEZn 211 for the purpose of stably supplying the manufacturing tool 450 with a constant amount of DEZn 211. DEZn 211 is vaporized at the vaporizer 246. The DEZn vapor may be diluted by argon which flow rate is controlled, and the mixture is supplied to the chamber 450 through the process valve 401.

If the filter 243 has captured many particles, a decrease of flow rate or stoppage happens. If the particles are not removed from the filter regularly, stable supply of the DEZn to the manufacturing tool becomes difficult. As discussed above, this problem was frequently solved by replacing the filter which results in added cost and time loss. The disclosed cleaning method makes it possible to clean the particles from the filter without detaching the filter from the supply system. One embodiment of the disclosed cleaning method is explained in detail in conjunction with FIG. 7. This embodiment consists of five steps:

1. Removal of DEZn;
2. Solvent cleaning;
3. Removal of solvent;
4. Acetonitrile cleaning; and
5. Dry.

$1^{st}$ Step

Decomposed DEZn remaining in the filter 243 is removed in this process. Preferably, the disclosed method is performed frequently enough to remove decomposed DEZn from the filter 243 to prevent complete blockage. Nitrogen 260 is sent to the DEZn supply lines 245 and 280 through the nitrogen in-line 261, the nitrogen in-valve 262, the cleaning solvent supply line 263, and the cleaning solvent supply valve 264. The nitrogen containing DEZn is sent to the abatement system 600 through the filter 243, the liquid mass flow controller 244, the vaporizer 246, the by-pass valve 402, the by-pass line 403, and the exhaust line 501 by the vacuum pump 500. Finally, the range extending from the cleaning solvent supply valve 264 and the DEZn supply valve 242 to the drain valve 404, the by-pass valve 402, and the process valve 401 (the "range") is kept decompressed by stopping nitrogen supply in this process. The filter 243 is included within the range.

$2^{nd}$ Step

The particles, such as Zn and/or ZnO, on the filter 243 are dissolved into the cleaning solvent 311 (for example, 4 vol % acetylacetone, 4 vol % triethylamine, and 92 vol % acetonitrile) in this step.

Nitrogen 320 is introduced through the nitrogen inlet line 321 and the nitrogen inlet valve 322 into the cleaning solvent tank 310. The cleaning solvent 311 is then introduced into the above range from the cleaning solvent siphon tube 331 through the cleaning solvent supply valve 332, the cleaning solvent supply line 333, the cleaning solvent supply valve 334, the cleaning solvent supply line 263, and the cleaning solvent supply valve 264. The cleaning solvent is stored in the range for a fixed time. The time is based upon the amount of the particles. Dissolution efficiency may be improved by application of a supersonic wave by the generator 248.

$3^{rd}$ Step

The cleaning solvent is discharged in the range in this step.

Nitrogen 260 is introduced into the range from the nitrogen inlet line 261, the nitrogen inlet valve 262, the cleaning solvent supply line 263, and the cleaning solvent supply valve 264. The cleaning solvent is discharged by nitrogen through the drain valve 404 and the drain line 405. Finally, the range is vacuumed by the vacuum pump 500. The exhaust gas is sent to the abatement system 600 through the by-pass valve 402, the by-pass line 403, and the exhaust line 501.

Steps 2 and 3 maybe repeated as necessary.

$4^{th}$ Step

Any cleaning solvent remaining in the range is removed by pure acetonitrile 351. Nitrogen 360 is introduced into the acetonitrile tank 350 is through the nitrogen inlet line 361 and the nitrogen inlet valve 362. Acetonitrile 351 is pushed up the acetonitrile siphon tube 371, and introduced into above-mentioned range through the acetonitrile supply valve 372, the acetonitrile supply line 373, the acetonitrile supply valve 374, the cleaning solvent supply line 263, and the cleaning solvent supply valve 264. After acetonitrile 351 is stored in the range for a fixed time, acetonitrile 351 is discharged by nitrogen 260 and the range is vacuumed. Nitrogen 260 is introduced into the above range through the nitrogen inlet line 261, the nitrogen inlet valve 262, the cleaning solvent supply line 263, and the cleaning solvent supply valve 264, and then acetonitrile 351 is discharged from the range through the drain valve 404 and the drain line 405. Nitrogen 260 is introduced into the range from the nitrogen inlet line 261, the nitrogen inlet valve 262, the cleaning solvent supply line 263, and the cleaning solvent supply valve 264. Acetonitrile 351 is discharged through the drain valve 404 and the drain line 405 to the drain tank 700. Finally, the range is vacuumed by the vacuum pump 500 through the by-pass valve 402, the by-pass line 403, and the exhaust line 501. By repeating this step a few times, acetonitrile introduction, discharge and vacuum, any cleaning solvent remaining in the range is removed.

Steps 2 through 4 maybe repeated as necessary.

$5^{th}$ Step

The range is dried by nitrogen in this step. Nitrogen 260 is introduced into the range through the nitrogen inlet line 261, the nitrogen inlet valve 262, the cleaning solvent supply line 263, and the cleaning solvent supply valve 264, and then nitrogen 260 is sent to the abatement system 600 through the by-pass valve 402, the by-pass line 403, and the exhaust line 501. The nitrogen purge is continued until the range is dried. The dry time during this purge may be reduced by heating, for example, by heating tape or rope heaters (not shown). When heating is used, the temperature should be kept below the heat-resistant limit of any parts within the range.

Previously, the filter 243 deposited with particles had to be cleaned after being detached from the supply line 245 or had to be replaced by a new one. As shown in this embodiment, the filter 243 may easily and safely be cleaned by the disclosed method without being detached.

Example 6

Cleaning the Bubbler Tank

Figure 8:
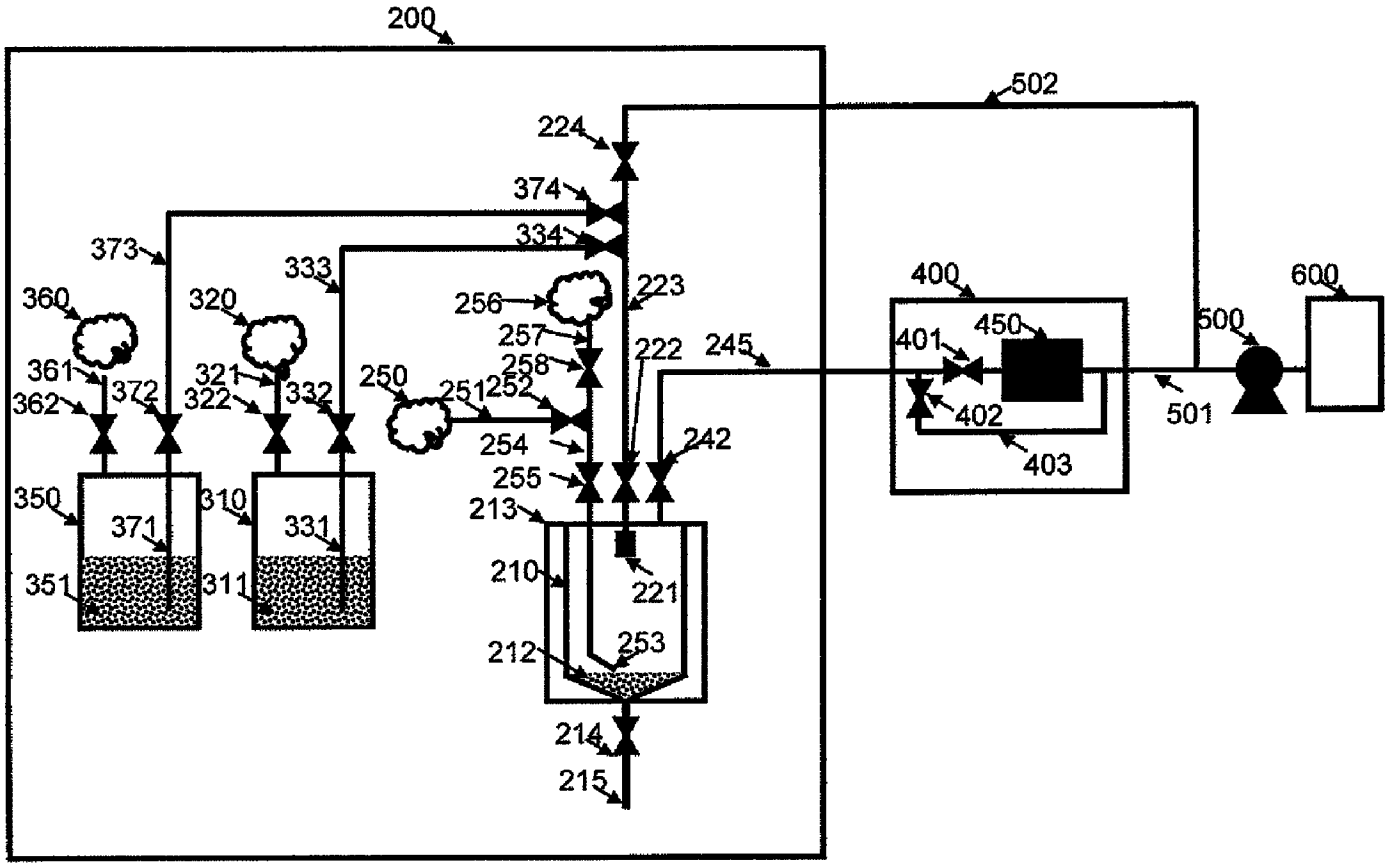
FIG. 8 is a diagram of a third embodiment of a system to supply a manufacturing tool with organometallic compound.
Figure 9:
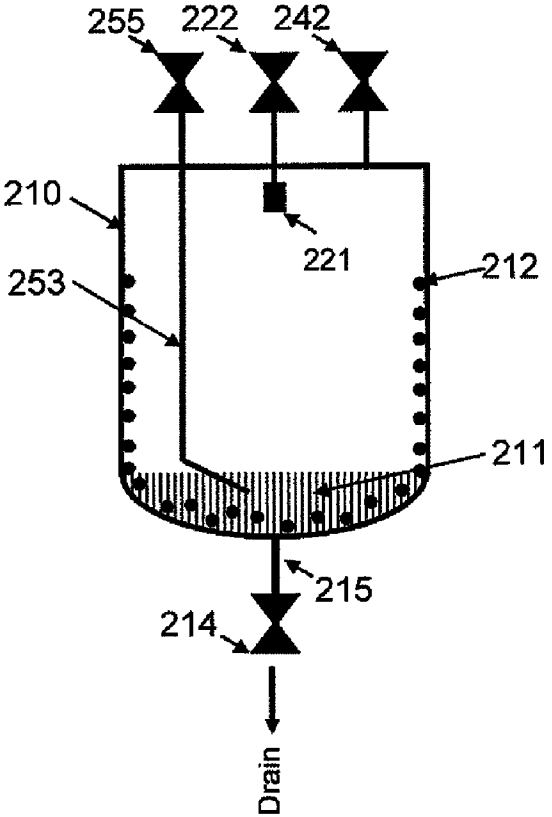
FIG. 9 is a diagram of the bubbler tank of FIG. 8.

One exemplary cleaning method of the bubble tank using the disclosed cleaning solvent 311 is explained in detail in conjunction with FIGS. 8 and 9. FIG. 8 is a diagram of one embodiment of a system to supply a manufacturing tool 400 with organometallic compound (not shown), such as DEZn, by using supply equipment 200 equipped with the disclosed cleaning solvent 311 for cleaning parts of the supply equipment 200 and manufacturing tool 400, as discussed in further detail below.

The feature of this embodiment is that the cleaning system is equipped to clean the bubbler tank 210, shown in more detail in FIG. 9, of the DEZn supply equipment 200. The bubbling supply method is one method to supply the manufacturing tool 400 with gaseous DEZn. The bubbling supply method is explained in conjunction with FIGS. 8 and 9.

Argon 250 is introduced into the bubbler tank 210 of the DEZn supply equipment 200 through the argon inlet line 251, the argon inlet valve 252, the argon inlet line 254 and the argon inlet valve 255. Argon 250 is injected into DEZn (not shown) from the sparger 253 and saturated with DEZn in the bubbler tank 210. The mixture is supplied to the chamber 450 in the manufacturing tool 400 through the DEZn supply valve 242, the DEZn supply line 245, and the process valve 401.

DEZn easily decomposes and generates decomposed compounds (Zn and/or ZnO) 212. The decomposed compounds 212 gradually deposit in the bubbler 210 while DEZn is supplied to the manufacturing tool 400. The decomposed compounds 212 may move downstream as particles, which causes trouble in the device manufacturing process and blockage of parts used in the supply system 200. To prevent this, the decomposed compounds 212 must be cleaned from the bubbler tank 210 regularly.

As discussed above, the bubbler tank 210 may be cleaned by detaching it from the supply equipment 200. However, as disclosed with reference to FIG. 1, the bubbler tank 210 may be operated without requiring detachment because, after usage and depletion of liquid in the bubbler 210, it may be refilled from a large scale tank (FIG. 1, 110) that is connected to the bubbler tank 210 by refill line (FIG. 1, 180). As a result, detaching the bubbler 210 each time to clean the decomposed compounds 212 becomes inefficient. Therefore, a method of cleaning the bubbler tank 210 without detaching it from the DEZn supply system 200 has been requested. Solution of this problem is difficult with the prior art cleaning solvent and method because the ordinary acid solvent is not designed for this and contains water that is highly reactive with DEZn. The disclosed cleaning solvent and method solves the problem. One embodiment of the disclosed cleaning method using the disclosed cleaning solvent is explained in detail in conjunction with FIG. 8.

This embodiment of the disclosed cleaning method consists of five steps:

1. Removal of DEZn;
2. Solvent cleaning;
3. Removal of solvent;
4. Acetonitrile cleaning; and
5. Dry.

1st Step

The bubbler tank 210 having decomposed compounds 212 (Zn and/or ZnO) deposited therein is vacuumed by the pump 500. The DEZn vapor in the bubbler tank 210 is vacuumed by the pump 500 through the DEZn supply valve 242, the DEZn supply line 245, the by-pass valve 402, the by-pass line 403, and the exhaust line 501 and is treated by the abatement system 600.

2nd Step

Cleaning solvent 311 is introduced into the vacuumed bubbler tank 210 to dissolve the decomposed compound (Zn and ZnO).

Nitrogen 320 is introduced into the cleaning solvent tank 310 through the nitrogen inlet line 321 and the nitrogen inlet valve 322. The cleaning solvent 311 is pushed up the cleaning solvent siphon tube 331, then the cleaning solvent 311 is sprayed to the bubbler tank 210 from the cleaning solvent nozzle 221 through the cleaning solvent supply valve 332, the cleaning solvent supply line 333, the cleaning solvent supply valve 334, the cleaning solvent supply line 223, and the cleaning solvent supply valve 222. The cleaning solvent 311 may efficiently be sprayed into the bubbler tank 210 thanks to some small holes on the cleaning solvent nozzle 221. The bubbler tank 210 filled with the cleaning solvent 311 is stored for a fixed time in order to dissolve the decomposed compound 212 into the cleaning solvent 311. The amount of time is based upon the amount of the decomposed compound 212. Heating the bubbler tank 210 with heating tool 213 may improve soaking effectiveness. When heating is used, the temperature should remain below the heat-resistance limit of any parts of the bubbler 210.

3rd Step

The cleaning solvent 311 in the bubbler tank 210 is stirred and drained. Nitrogen 256 is violently injected into the cleaning solvent from the sparger 253 through the nitrogen inlet line 257, the nitrogen inlet valve 258, the argon inlet line 254, and the argon inlet valve 255. The cleaning solvent 311 is stirred well by bubbling of nitrogen 256, and then the cleaning solvent 311 is drained to the drain tank (not shown) through the drain valve 214 and the drain line 215. After draining, the bubbler tank 210 is vacuumed by the vacuum pump 500. The exhaust is treated by the abatement system 600 through the cleaning solvent nozzle 221, the cleaning solvent supply valve 222, the cleaning solvent supply line 223, the exhaust valve 224, the exhaust line 502, and the exhaust line 501.

4th Step

Acetonitrile 351 is introduced into the bubbler tank 210 to remove any residual cleaning solvent remaining. Nitrogen 360 is introduced into the acetonitrile tank 350 through the nitrogen inlet line 361 and the nitrogen inlet valve 362 to pressurize the acetonitrile tank 350. Acetonitrile 351 is pushed up the acetonitrile siphon tube 371 and violently sprayed into the vacuumed bubbler tank 210 from the cleaning solvent nozzle 221 through the acetonitrile supply valve 372, the acetonitrile supply line 373, the acetonitrile supply valve 374, the cleaning solvent supply line 223, and the cleaning solvent supply valve 222. The bubbler tank 210 filled with acetonitrile 351 is stored for a fixed time to dissolve any remaining cleaning solvent. Next, nitrogen 256 is violently introduced into acetonitrile 351 in the bubbler tank 210 from the sparger 253 through the nitrogen inlet line 257, the nitrogen inlet valve 258, the argon inlet line 254, and the argon inlet valve 255. Acetonitrile 351 is then drained to the drain tank (not shown) through the drain valve 214 and the drain line 215. After draining, the bubbler tank 210 is vacuumed by the vacuum pump 500. The exhaust is treated by the abatement system 600 through the cleaning solvent nozzle 221, the cleaning solvent supply valve 222, the cleaning solvent supply line 223, the exhaust valve 224, the exhaust line 502, and the exhaust line 501. Finally, the bubbler tank 210 is vacuumed. By repeating this step, acetonitrile introduction, drain, and vacuum, any residual cleaning solvent in the bubbler tank 210 containing zinc acetylacetonate is removed.

5th Step

The bubbler tank 210 wet with acetonitrile is dried by nitrogen 256 in this step. Nitrogen 256 is introduced into the bubbler tank 210 through the nitrogen inlet line 257, the nitrogen inlet valve 258, the argon inlet line 254, the argon inlet valve 255, and the sparger 253. Nitrogen 256 is then sent to the abatement system 600 through the cleaning solvent nozzle 221, the cleaning solvent supply valve 222, the cleaning solvent supply line 223, the exhaust valve 224, the exhaust line 502, the exhaust line 501, and the vacuum pump 500. The nitrogen purge is continued until the bubbler tank 210 is dried. Drying time may be reduced during nitrogen purge by use of heat, vacuum, or both.

The supply tank 210, such as the bubbler tank, is refilled with the DEZn from the big storage tank (FIG. 1, 110) when the liquid level decreases. Therefore, deposition in the supply tank 210 of the decomposed compounds 212 from DEZn occurs gradually. But detaching the supply tank 210 is not as easy as detaching the storage tank (FIG. 1, 110) to refill the chemical. Therefore, the disclosed cleaning method of the supply tank 210 without requiring detachment is industrially important. The disclosed cleaning solvent 311 is not corrosive or reactive with DEZn. In addition, the cleaning solvent nozzle 221 and the effect of nitrogen bubbling from the sparger 253 before draining the liquid effectively clean the bubbler tank 210 having widely deposited decomposed compounds 212.

Example 7

Tube Cleaning

Figure 10:
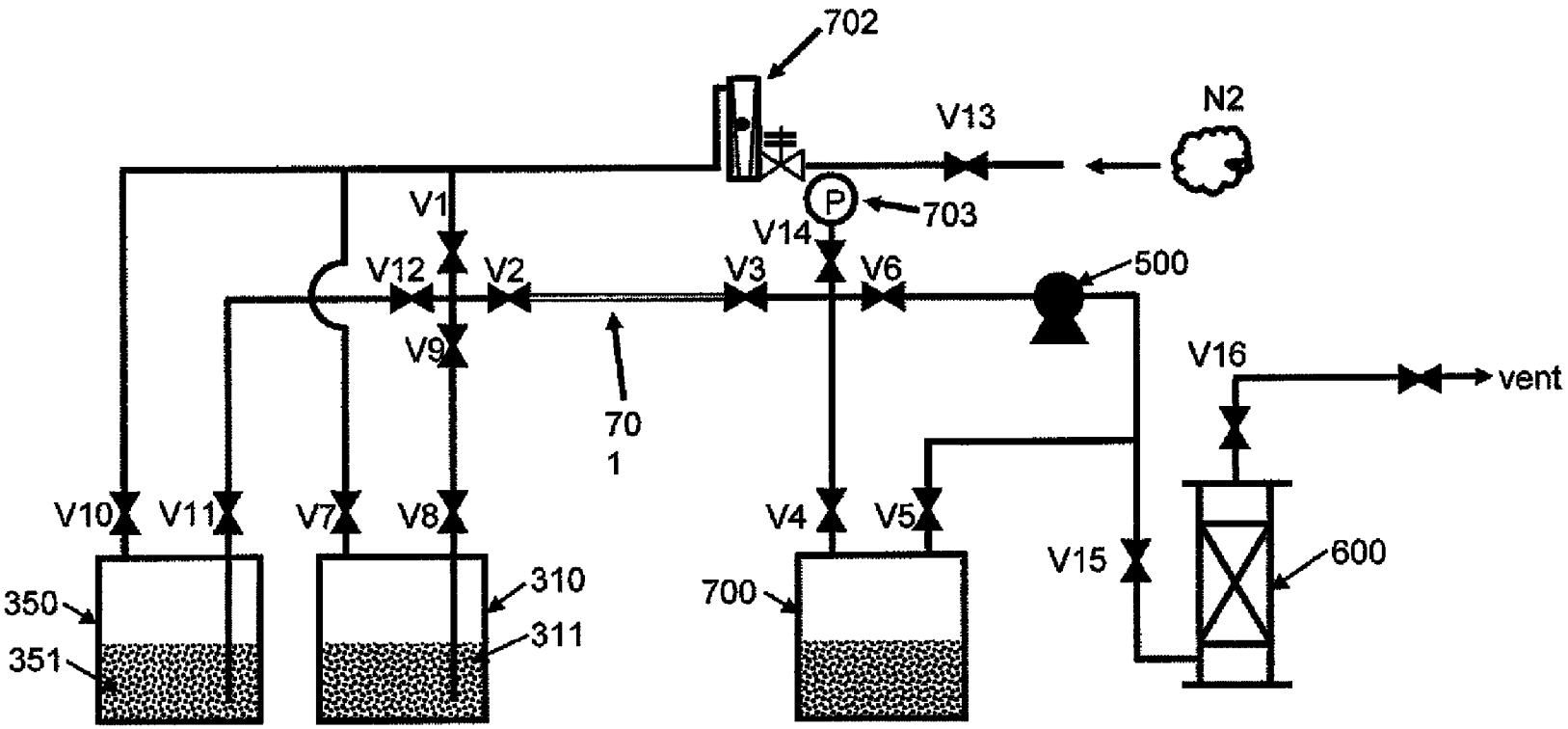
FIG. 10 is a diagram of the cleaning test tool used to determine how many zinc particles are removed from an actual supply tube.

Tube cleaning tests were conducted using the disclosed cleaning solvents to determine how many zinc particles are removed from an actual supply tube. The cleaning test tool is shown in FIG. 10. The tool was equipped with a tank 350 for acetonitrile 351, a tank 310 for the cleaning solvent 311, a drain tank 700, a pump 500, an abatement system 600, a flow controller 702, a pressure sensor 703, and valves, each numerically indicated. The cleaning solvent 311 consists of 4 vol % acetylacetone (acacH), 4 vol % triethylamine, and 92 vol % acetonitrile. Zinc particles deposited on the cleaning target tube 701 (13 mm, SS316L EP) were prepared by introduction of 100 μl DEZn followed by exposure to air for one night. The estimated amount of Zn in the zinc particles is about 62.19 mg. This estimate was determined by ICP-MS. The following cleaning steps were followed and, unless otherwise stated, all of the valves are closed:

1. Introduction of Cleaning Solvent
   Vacuum the target tube 701 (V16 open→V15 open→pump 500 on→V6 open→V14 open→V3 open→V2 open)
   Introduction of the cleaning solvent (V13 open→V7 open→V8 open→V9 open→V2 open)
2. Soaking with Cleaning Solvent
   The cleaning solvent was stored in the tube 701 for 30 minutes
3. Removal of Cleaning Solvent
   Draining the cleaning solvent (V13 open→V1 open→V16 open→V15 open→V5 open→V4 open→V3 open→V2 open)
4. Introduction of Acetonitrile
   Vacuum the target tube 701 (V16 open→V15 open→pump 500 on→V6 open→V14 open→V3 open→V2 open)
   Introduction of acetonitrile (V13 open→V10 open→V11 open→V12 open→V2 open)
5. Removal of Acetonitrile
   Drain of the acetonitrile (V13 open→V1 open→V16 open→V15 open→V5 open→V4 open→V3 open→V2 open)
6. Nitrogen Purge
   Dry the target tube 701 by nitrogen purge (V13 open→V1 open→V16 open→V15 open→V6 open→V3 open→V2 open)

The following procedure was utilized to remove the zinc particles from the target tube 701. Steps 1 through 3 were repeated five times (1→2→3). Then steps 4 and 5 were repeated five times. Finally, the target tube 701 was dried by nitrogen for 30 minutes.

Figure 11:
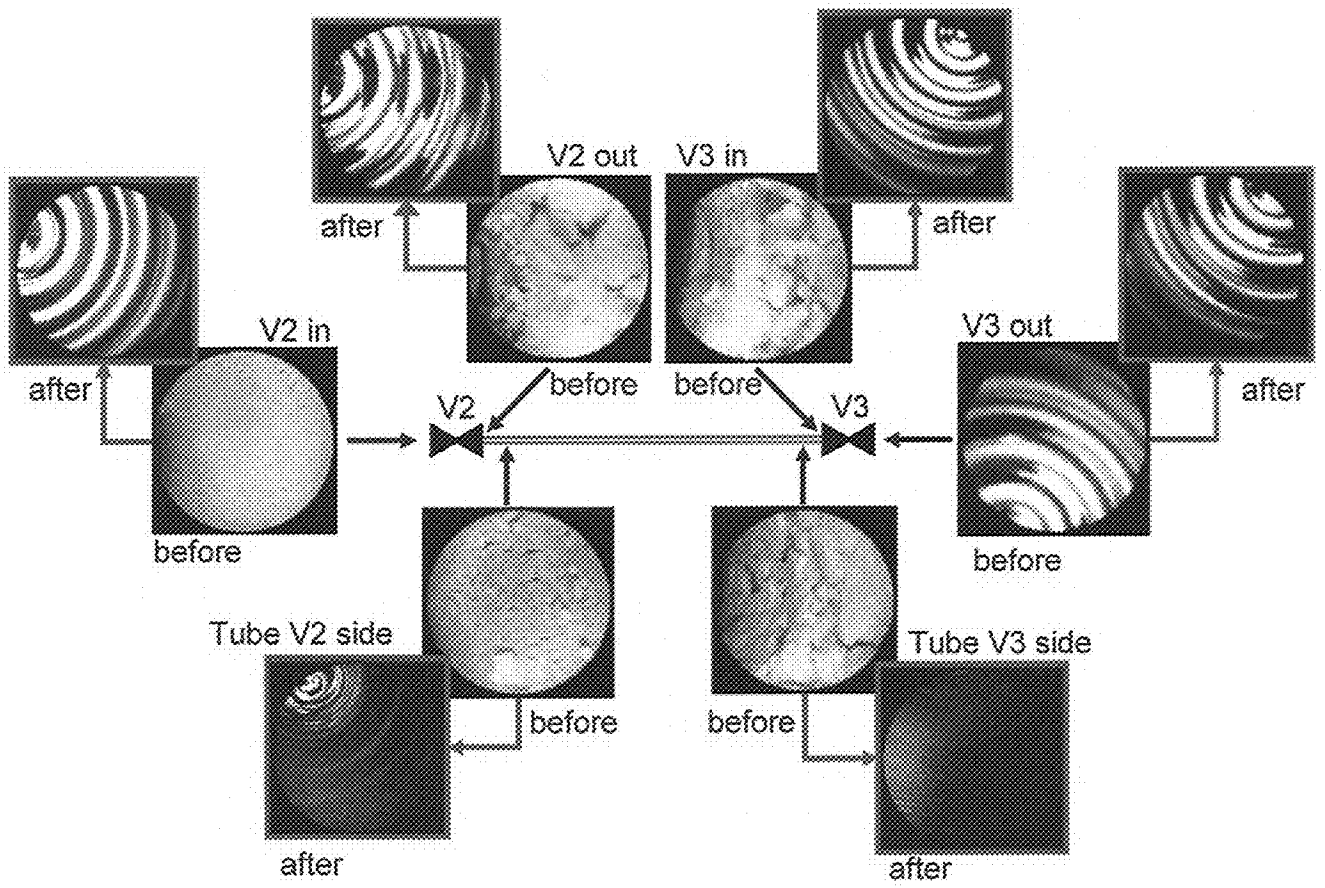
FIG. 11 is pictures of the target tube and valves of FIG. 10 before and after cleaning by one embodiment of the disclosed method.

FIG. 11 is pictures of the target tube 701 and valves V2 and V3 before and after cleaning. There were many zinc particles on the tube 701 and valves before cleaning, except for the side of valve V3 closer to valve V6 (hereinafter "V3 out"). The zinc particles were removed well after cleaning and the stainless steel luster of the parts returned. The zinc remaining in the tube after cleaning was measured by ICP-MS. The result was 0.13 mg. The zinc removal rate was 99.8%[62.19−0.13)/62.19*100].

Figure 12:
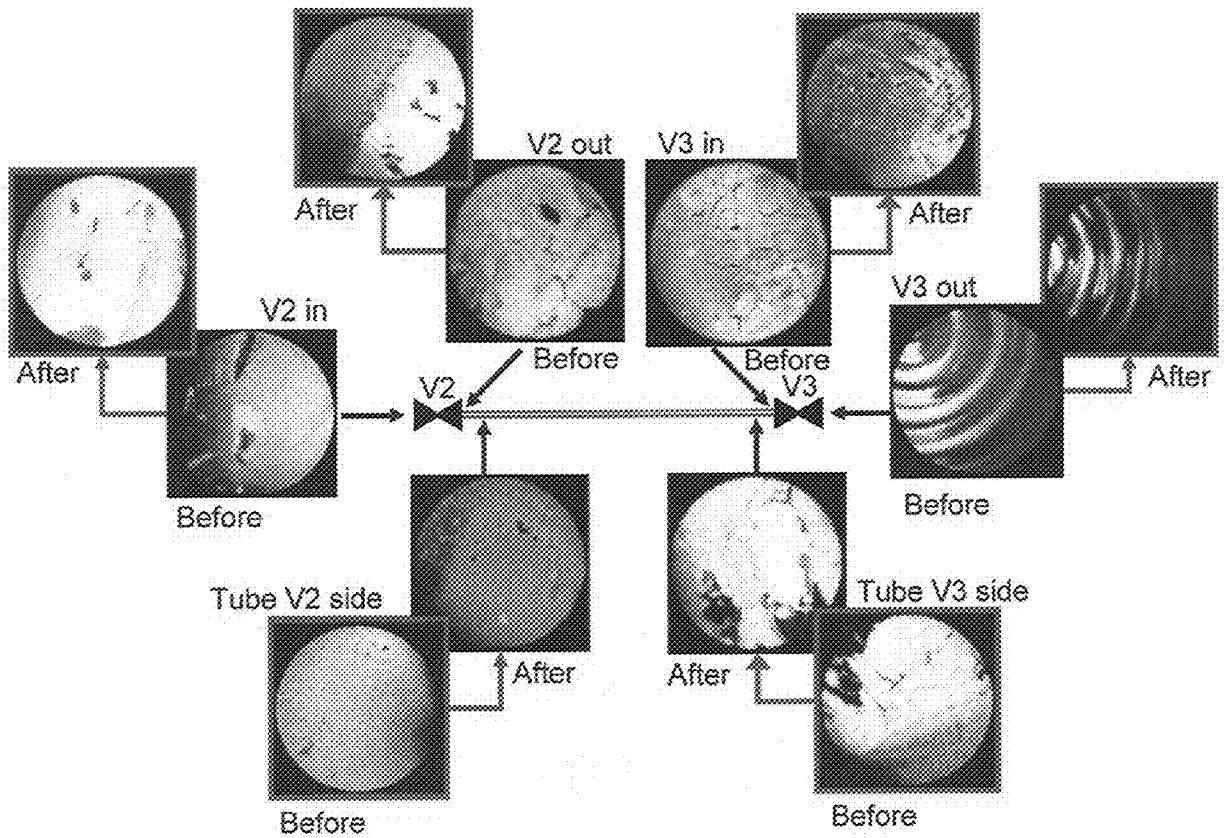
FIG. 12 is pictures of the target tube and valves after cleaning by the diluent alone.

As a reference, the target tube 701 was cleaned by only acetonitrile to compare with the results of the cleaning solvent. The procedure is as follows: steps 4 and 5 were repeated five times. The target tube 701 was then dried by nitrogen for 30 minutes. FIG. 12 is pictures of the target tube 701 and valves V2 and V3 after only acetonitrile cleaning. Zinc particles were not removed well and the stainless steel luster of these parts did not return in a manner similar to the results obtained with the disclosed cleaning solvent. The amount of zinc remaining in the tube after cleaning was measured by ICP-MS. The result was 22.24 mg. The zinc removal rate by only acetonitrile cleaning was 64.2%[(62.19−22.24)/62.19*100].

The cleaning solvent (4 vol % acetylacetone (acacH), 4 vol % triethylamine, and 92 vol % acetonitrile) removed Zn particles in the actual supply tube well. The effect of cleaning solvent and cleaning method is obvious by comparison with result of only acetonitrile cleaning. This experiment indicates that the disclosed cleaning solvent removes Zn particles effectively because cleaning by acetonitrile alone does not dissolve the Zn complex and therefore does not remove Zn particles well.

Example 8

Bubbler Cleaning

Figure 13:
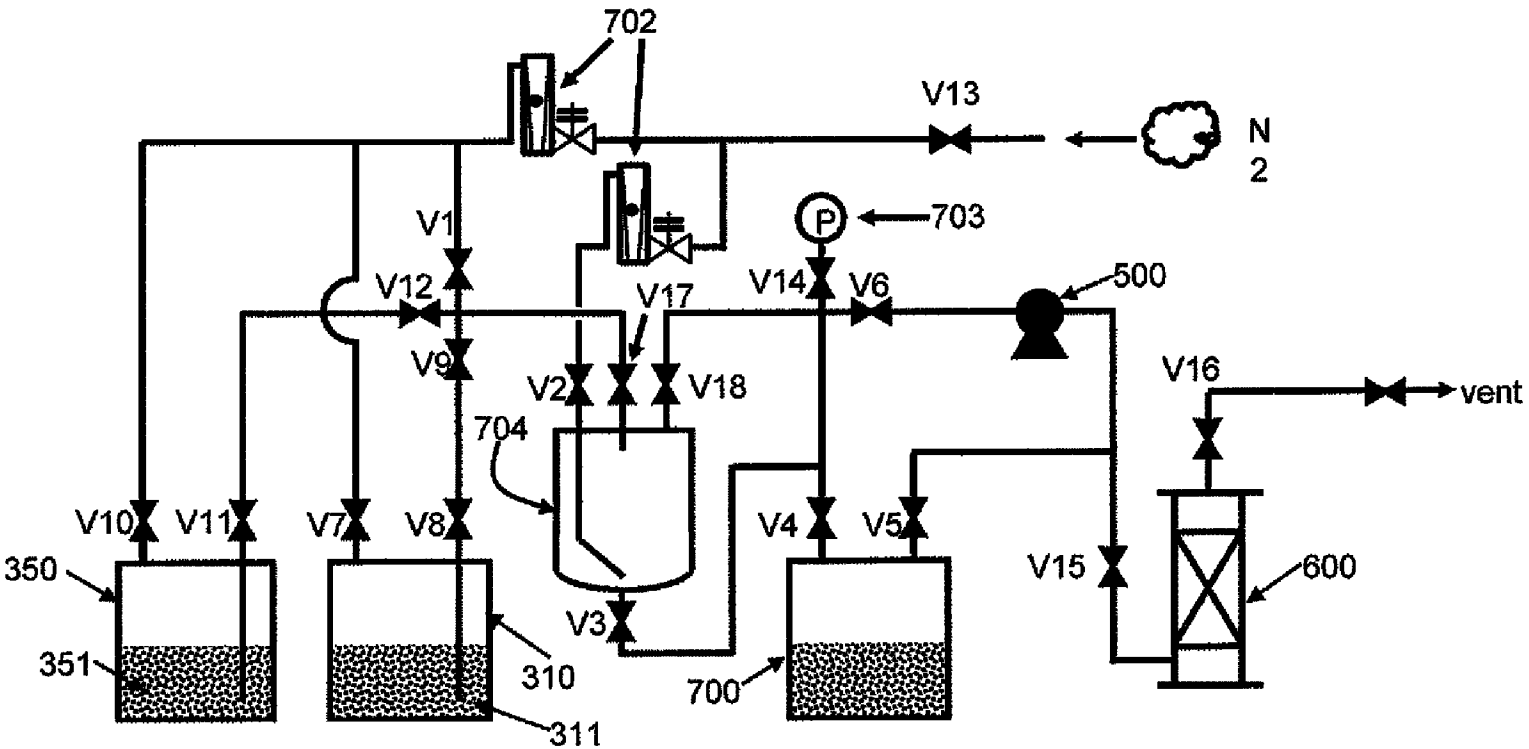
FIG. 13 is a diagram of the cleaning test tool used to determine how many zinc particles are removed from an actual bubbler tank.

A bubbler cleaning test was conducted using the disclosed cleaning solvent to determine how many zinc particles are removed. The cleaning test tool is shown in FIG. 13. This tool was equipped with a tank 350 for acetonitrile 351, a tank 310 for the cleaning solvent 311, a drain tank 700, a pump 500, an abatement system 600, two flow controllers 702, a pressure sensor 703, and valves, each numerically indicated. The cleaning solvent consists of 4 vol % acetylacetone (acacH), 4 vol % triethylamine, and 92 vol % acetonitrile. Zinc particles on the cleaning target bubbler 704 (100 mL, SS316L) were prepared by DEZn introduction (100 μL), then exposed to air for one night. The estimate of amount of Zn in the zinc particles is about 62.19 mg.

The structure of the bubbler 704 used in this experiment is shown in FIG. 9. This bubbler 704 has a characteristic bottom which has a slope toward the bottom center and has a drain port at the center of the bottom. Thanks to this structure, liquid in the bubbler 704 is easy to drain along with any remaining Zn particles. This bubbler 704 was designed to be cleaned easily. However, the disclosed method may still be effectively utilized with other bubblers known in the art.

The following cleaning steps were followed and, unless otherwise stated, all of the valves are closed.

1. Introduction of Cleaning Solvent
   Vacuum the target bubbler 704 (V16 open→V15 open→pump 500 on→V6 open→V14 open→V18 open→V17 open)
   Introduction of the cleaning solvent (V13 open→V7 open→V8 open→V9 open→V17 open)
2. Soaking with Cleaning Solvent
   The cleaning solvent was stored in the bubbler 704 for 30 minutes
3. Removal of Cleaning Solvent
   Drain the cleaning solvent (V13 open→V1 open→V16 open→V15 open→V5 open→V4 open→V17 open→V3 open)
4. Introduction of Acetonitrile
   Vacuum the bubbler 704 (V16 open→V15 open→pump 500 on→V6 open→V14 open→V18 open→V17 open)
   Introduction of acetonitrile (V13 open→V10 open→V11 open→V12 open→17 open)
5. Removal of Acetonitrile
   Drain the acetonitrile (V13 open→V1 open→V16 open→V15 open→V5 open→V4 open→V17 open→V3 open)
6. Nitrogen Purge
   Dry the target bubbler 704 by nitrogen purge (V13 open→V1 open→V16 open→V15 open→V6 open→V17 open→V18 open→V2 open→V3 open)

Figure 14:
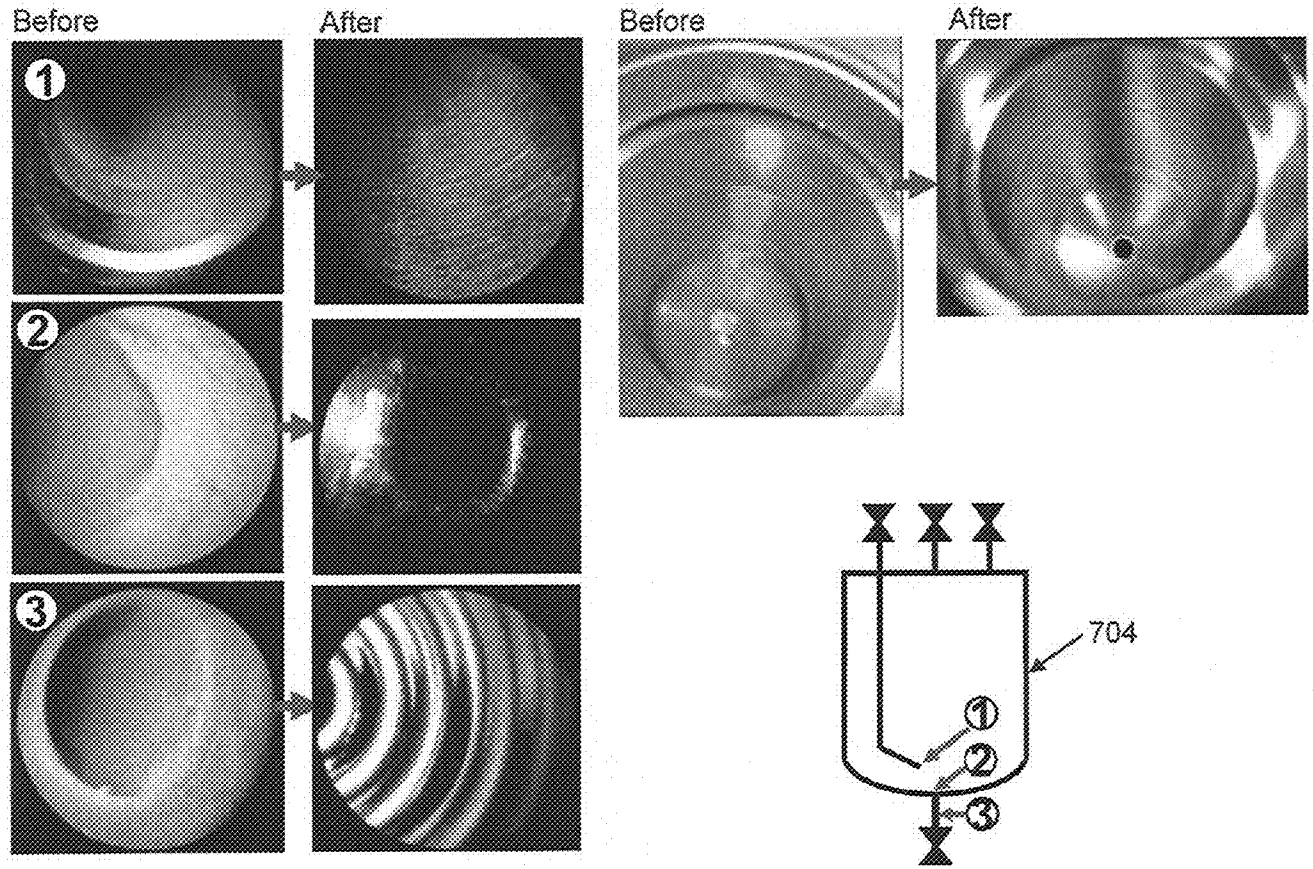
FIG. 14 is pictures of the bubbler, valve, and port before and after cleaning by one embodiment of the disclosed method.

The following procedure was utilized to clean the zinc particles from the target bubbler 704. The cleaning solvent purge step was repeated five times (1→2→3). Then the acetonitrile purge step was repeated five times (4→5). Finally, the target bubbler 704 was dried by nitrogen for 30 minutes (6). Many zinc particles were on the bubbler 704, end 1 of the sparger, bubbler outlet 2, and drain line 3 before cleaning, as shown in FIG. 14. The zinc particles were removed well after cleaning and the stainless steel luster of these parts returned. The zinc particles could not be seen by microscope observation. The amount of zinc remaining in the bubbler 704 after the cleaning was measured by ICP-MS. The result was 0.27 mg. The removal rate was 99.6%[(62.19−0.27)/62.19*100).

Figure 15:
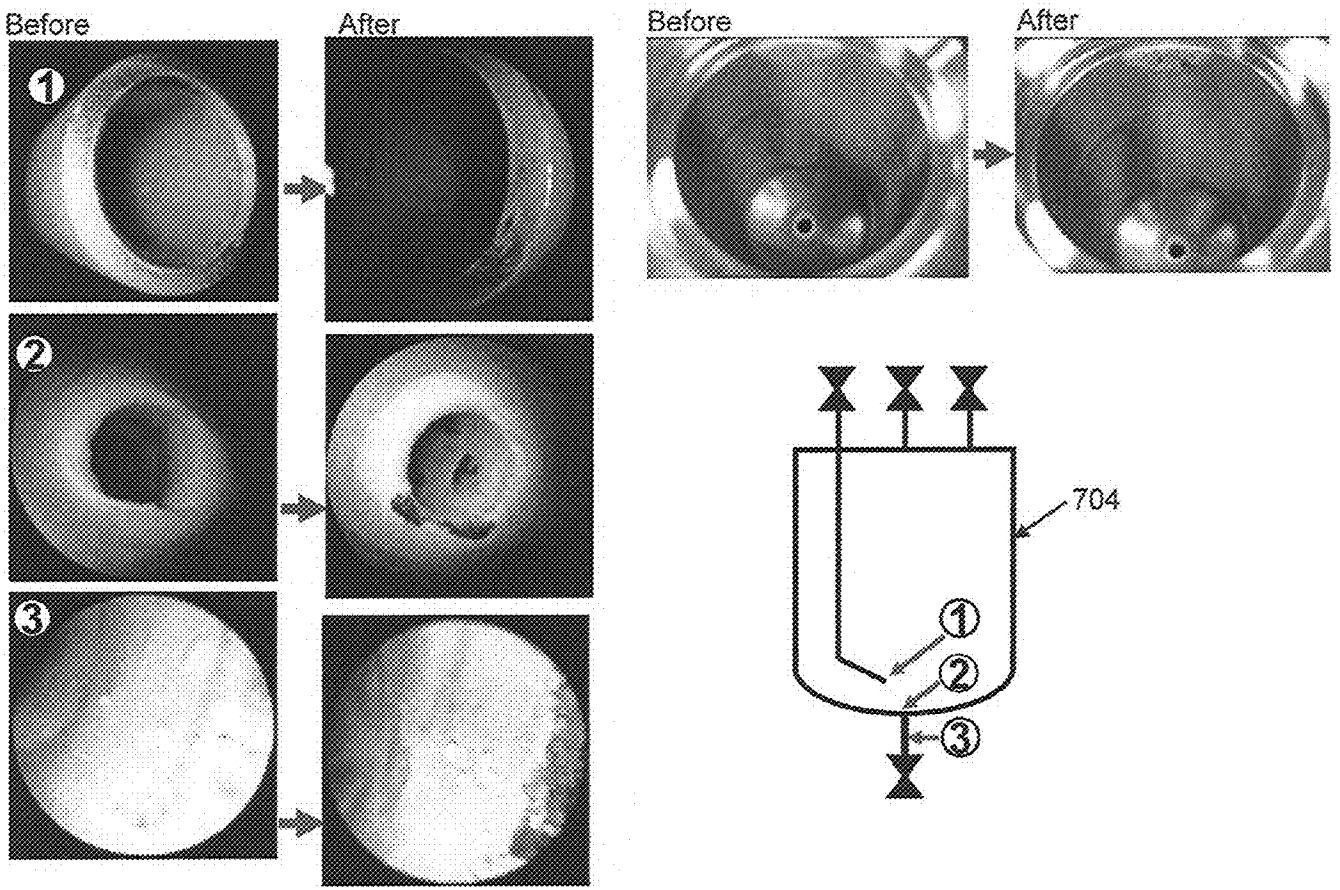
FIG. 15 is pictures of the bubbler, valve, and port before and after cleaning by the diluent alone.

As a reference, the target bubbler 704 with zinc particles was cleaned by only acetonitrile to confirm how the cleaning solvent (4 vol % acetylacetone (acacH), 4 vol % triethylamine, and 92 vol % acetonitrile) removes zinc particles without help of physical cleaning effect, such as liquid introduction, vacuum and nitrogen purge. The acetonitrile purge was repeated five times (4→5). Finally, the target bubbler was dried by nitrogen for 30 minutes (6). Many zinc particles were on the bubbler 704, end 1 of the sparger, bubbler outlet 2, and drain line 3 before cleaning, as shown in FIG. 15. The zinc particles, however, were not removed well after cleaning by comparison with the result of innovative cleaning solvent and the luster of stainless steel of these parts did not return. The amount of zinc remaining in the bubbler after the acetonitrile cleaning was measured by ICP-MS. The result was 48.46 mg. The removal rate was 22.1% [(62.19−48.46)/62.19*100).

The disclosed cleaning solvents, methods, and bubbler structure were obviously effective to remove Zn particles in the bubbler as shown in this experiment.

It will be understood that many additional changes in the details, materials, steps, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

What is claimed is:

1. A method of cleaning equipment parts used in the photovoltaic or semiconductor industry, the method comprising the steps:
   contacting a surface of the equipment parts contaminated with a metallic compound with a cleaning solvent consisting of:
   a diluent selected from the group consisting of acetonitrile, acetone, and tetrahydrofuran,
   an accelerator, wherein the accelerator is a tertiary amine and
   a diketone compound having the formula R1-CO—CHR2-CO—R3,
   wherein R1, R2, and R3 are independently selected from the group consisting of hydrogen, an alkyl group, and an oxygen-substituted alkyl group; and
   removing the cleaning solvent to remove the metallic compound from the surface of the equipment parts.

2. The method of claim 1, further comprising heating the cleaning solvent during the contacting step, sonicating the cleaning solvent during the contacting step, or both.

3. The method of claim 1, further comprising rinsing the equipment parts with the diluent after removing the cleaning solvent.

4. The cleaning method of claim 1, further comprising drying the surface of the equipment parts with an inert gas after removing the cleaning solvent.

5. The cleaning method of claim 1, wherein the diketone is acetylacetone and the diluent is acetonitrile.

6. The cleaning method of claim 1, wherein the metallic compound is selected from the group consisting of Al, Ga, In, Sn, Zn, Cd, metal oxides thereof, and mixtures thereof.

7. The cleaning method of claim 1, wherein the tertiary amine is triethylamine.

8. The cleaning method of claim 6, wherein the metallic compound is Zn and ZnO.

* * * * *